US006982732B2

(12) United States Patent
Suzuki

(10) Patent No.: US 6,982,732 B2
(45) Date of Patent: Jan. 3, 2006

(54) DISPLAY PANEL DRIVING METHOD WITH SELECTABLE DRIVING PATTERN

(75) Inventor: Masahiro Suzuki, Yamanashi (JP)

(73) Assignees: Pioneer Corporation, Tokyo (JP); Shizuoka Pioneer Corporation, Shizuoka (JP)

( * ) Notice: Subject to any disclaimer, the term of this patent is extended or adjusted under 35 U.S.C. 154(b) by 209 days.

(21) Appl. No.: 10/163,593

(22) Filed: Jun. 7, 2002

(65) Prior Publication Data

US 2003/0112256 A1 Jun. 19, 2003

(30) Foreign Application Priority Data

Jun. 15, 2001 (JP) ..... 2001-181109

(51) Int. Cl.
*G09G 5/02* (2006.01)

(52) U.S. Cl. ..... 345/693; 345/691; 345/690

(58) Field of Classification Search ..... 345/60, 345/63, 87–89, 690–693

See application file for complete search history.

(56) References Cited

U.S. PATENT DOCUMENTS 6,388,645 B2 * 5/2002 Kasahara et al. ..... 345/63
6,414,658 B1 * 7/2002 Tokunaga ..... 345/63
6,476,801 B2 * 11/2002 Nagai ..... 345/213
6,646,625 B1 * 11/2003 Shigeta et al. ..... 345/63

* cited by examiner

*Primary Examiner*—Dennis-Doon Chow
*Assistant Examiner*—Tom Sheng
(74) *Attorney, Agent, or Firm*—Sughrue Mion, PLLC

(57) ABSTRACT

A display panel driving method that is capable of displaying images with false contours suppressed and without the occurrence of flicker, even when the vertical sync frequency of the input image signal is low. When an image signal with a low mean brightness level is input, or when an image signal having a comparatively high vertical sync frequency is input, light emission elements comprised by pixels are caused to emit light in a number of continuous subfields corresponding to the brightness level expressed by the input image signal in one field. If an image signal is input in which the mean brightness level is high, and in addition the vertical sync frequency is comparatively low, light emission elements are caused to emit light in a number of continuous subfields corresponding to the brightness level expresses by the image signal, in each of the first half and the second half of a field.

16 Claims, 29 Drawing Sheets

FIG. 3 PRIOR ART

| GRAYSCALE | EMISSION DRIVING PATTERNS IN ONE FIELD | | | | | | | | BRIGHTNESS |
|---|---|---|---|---|---|---|---|---|---|
| | SF 1 | SF 2 | SF 3 | SF 4 | SF 5 | SF 6 | SF 7 | SF 8 | |
| 1 | | | | | | | | | 0 |
| 2 | ○ | | | | | | | | 1 |
| 3 | ○ | ○ | | | | | | | 7 |
| 4 | ○ | ○ | ○ | | | | | | 23 |
| 5 | ○ | ○ | ○ | ○ | | | | | 47 |
| 6 | ○ | ○ | ○ | ○ | ○ | | | | 82 |
| 7 | ○ | ○ | ○ | ○ | ○ | ○ | | | 128 |
| 8 | ○ | ○ | ○ | ○ | ○ | ○ | ○ | | 185 |
| 9 | ○ | ○ | ○ | ○ | ○ | ○ | ○ | ○ | 255 |

○ : EMISSION

FIG. 7

| BRIGHTNESS | D | BRIGHTNESS | $D_H$ | BRIGHTNESS | D | BRIGHTNESS | $D_H$ |
|---|---|---|---|---|---|---|---|
| | 0 ~ 7 | | 0 ~ 7 | | 0 ~ 7 | | 0 ~ 7 |
| 0 | 00000000 | 0 | 00000000 | 64 | 01000000 | 56 | 00111000 |
| 1 | 00000001 | 0 | 00000000 | 65 | 01000001 | 57 | 00111001 |
| 2 | 00000010 | 1 | 00000001 | 66 | 01000010 | 57 | 00111001 |
| 3 | 00000011 | 2 | 00000010 | 67 | 01000011 | 58 | 00111010 |
| 4 | 00000100 | 3 | 00000011 | 68 | 01000100 | 59 | 00111011 |
| 5 | 00000101 | 4 | 00000100 | 69 | 01000101 | 60 | 00111100 |
| 6 | 00000110 | 5 | 00000101 | 70 | 01000110 | 61 | 00111101 |
| 7 | 00000111 | 6 | 00000110 | 71 | 01000111 | 62 | 00111110 |
| 8 | 00001000 | 7 | 00000111 | 72 | 01001000 | 63 | 00111111 |
| 9 | 00001001 | 7 | 00000111 | 73 | 01001001 | 64 | 01000000 |
| 10 | 00001010 | 8 | 00001000 | 74 | 01001010 | 65 | 01000001 |
| 11 | 00001011 | 9 | 00001001 | 75 | 01001011 | 65 | 01000001 |
| 12 | 00001100 | 10 | 00001010 | 76 | 01001100 | 66 | 01000010 |
| 13 | 00001101 | 11 | 00001011 | 77 | 01001101 | 67 | 01000011 |
| 14 | 00001110 | 12 | 00001100 | 78 | 01001110 | 68 | 01000100 |
| 15 | 00001111 | 13 | 00001101 | 79 | 01001111 | 69 | 01000101 |
| 16 | 00010000 | 14 | 00001110 | 80 | 01010000 | 70 | 01000110 |
| 17 | 00010001 | 14 | 00001110 | 81 | 01010001 | 71 | 01000111 |
| 18 | 00010010 | 15 | 00001111 | 82 | 01010010 | 72 | 01001000 |
| 19 | 00010011 | 16 | 00010000 | 83 | 01010011 | 72 | 01001000 |
| 20 | 00010100 | 17 | 00010001 | 84 | 01010100 | 73 | 01001001 |
| 21 | 00010101 | 18 | 00010010 | 85 | 01010101 | 74 | 01001010 |
| 22 | 00010110 | 19 | 00010011 | 86 | 01010110 | 75 | 01001011 |
| 23 | 00010111 | 20 | 00010100 | 87 | 01010111 | 76 | 01001100 |
| 24 | 00011000 | 21 | 00010101 | 88 | 01011000 | 77 | 01001101 |
| 25 | 00011001 | 21 | 00010101 | 89 | 01011001 | 77 | 01001101 |
| 26 | 00011010 | 22 | 00010110 | 90 | 01011010 | 78 | 01001110 |
| 27 | 00011011 | 23 | 00010111 | 91 | 01011011 | 79 | 01001111 |
| 28 | 00011100 | 24 | 00011000 | 92 | 01011100 | 80 | 01010000 |
| 29 | 00011101 | 25 | 00011001 | 93 | 01011101 | 81 | 01010001 |
| 30 | 00011110 | 26 | 00011010 | 94 | 01011110 | 82 | 01010010 |
| 31 | 00011111 | 27 | 00011011 | 95 | 01011111 | 83 | 01010011 |
| 32 | 00100000 | 28 | 00011100 | 96 | 01100000 | 84 | 01010100 |
| 33 | 00100001 | 28 | 00011100 | 97 | 01100001 | 85 | 01010101 |
| 34 | 00100010 | 29 | 00011101 | 98 | 01100010 | 86 | 01010110 |
| 35 | 00100011 | 30 | 00011110 | 99 | 01100011 | 86 | 01010110 |
| 36 | 00100100 | 31 | 00011111 | 100 | 01100100 | 87 | 01010111 |
| 37 | 00100101 | 32 | 00100000 | 101 | 01100101 | 88 | 01011000 |
| 38 | 00100110 | 33 | 00100001 | 102 | 01100110 | 89 | 01011001 |
| 39 | 00100111 | 34 | 00100010 | 103 | 01100111 | 90 | 01011010 |
| 40 | 00101000 | 35 | 00100011 | 104 | 01101000 | 91 | 01011011 |
| 41 | 00101001 | 36 | 00100100 | 105 | 01101001 | 92 | 01011100 |
| 42 | 00101010 | 36 | 00100100 | 106 | 01101010 | 93 | 01011101 |
| 43 | 00101011 | 37 | 00100101 | 107 | 01101011 | 93 | 01011101 |
| 44 | 00101100 | 38 | 00100110 | 108 | 01101100 | 94 | 01011110 |
| 45 | 00101101 | 39 | 00100111 | 109 | 01101101 | 95 | 01011111 |
| 46 | 00101110 | 40 | 00101000 | 110 | 01101110 | 96 | 01100000 |
| 47 | 00101111 | 41 | 00101001 | 111 | 01101111 | 97 | 01100001 |
| 48 | 00110000 | 42 | 00101010 | 112 | 01110000 | 98 | 01100010 |
| 49 | 00110001 | 43 | 00101011 | 113 | 01110001 | 99 | 01100011 |
| 50 | 00110010 | 43 | 00101011 | 114 | 01110010 | 100 | 01100100 |
| 51 | 00110011 | 44 | 00101100 | 115 | 01110011 | 101 | 01100101 |
| 52 | 00110100 | 45 | 00101101 | 116 | 01110100 | 101 | 01100101 |
| 53 | 00110101 | 46 | 00101110 | 117 | 01110101 | 102 | 01100110 |
| 54 | 00110110 | 47 | 00101111 | 118 | 01110110 | 103 | 01100111 |
| 55 | 00110111 | 48 | 00110000 | 119 | 01110111 | 104 | 01101000 |
| 56 | 00111000 | 49 | 00110001 | 120 | 01111000 | 105 | 01101001 |
| 57 | 00111001 | 50 | 00110010 | 121 | 01111001 | 106 | 01101010 |
| 58 | 00111010 | 50 | 00110010 | 122 | 01111010 | 107 | 01101011 |
| 59 | 00111011 | 51 | 00110011 | 123 | 01111011 | 108 | 01101100 |
| 60 | 00111100 | 52 | 00110100 | 124 | 01111100 | 108 | 01101100 |
| 61 | 00111101 | 53 | 00110101 | 125 | 01111101 | 109 | 01101101 |
| 62 | 00111110 | 54 | 00110110 | 126 | 01111110 | 110 | 01101110 |
| 63 | 00111111 | 55 | 00110111 | 127 | 01111111 | 111 | 01101111 |

FIG. 8

| BRIGHTNESS D | | BRIGHTNESS $D_H$ | | BRIGHTNESS D | | BRIGHTNESS $D_H$ | |
|---|---|---|---|---|---|---|---|
| | 0 ~ 7 | | 0 ~ 7 | | 0 ~ 7 | | 0 ~ 7 |
| 128 | 10000000 | 112 | 01110000 | 192 | 11000000 | 168 | 10101000 |
| 129 | 10000001 | 113 | 01110001 | 193 | 11000001 | 169 | 10101001 |
| 130 | 10000010 | 114 | 01110010 | 194 | 11000010 | 170 | 10101010 |
| 131 | 10000011 | 115 | 01110011 | 195 | 11000011 | 171 | 10101011 |
| 132 | 10000100 | 115 | 01110011 | 196 | 11000100 | 172 | 10101100 |
| 133 | 10000101 | 116 | 01110100 | 197 | 11000101 | 173 | 10101101 |
| 134 | 10000110 | 117 | 01110101 | 198 | 11000110 | 173 | 10101101 |
| 135 | 10000111 | 118 | 01110110 | 199 | 11000111 | 174 | 10101110 |
| 136 | 10001000 | 119 | 01110111 | 200 | 11001000 | 175 | 10101111 |
| 137 | 10001001 | 120 | 01111000 | 201 | 11001001 | 176 | 10110000 |
| 138 | 10001010 | 121 | 01111001 | 202 | 11001010 | 177 | 10110001 |
| 139 | 10001011 | 122 | 01111010 | 203 | 11001011 | 178 | 10110010 |
| 140 | 10001100 | 122 | 01111010 | 204 | 11001100 | 179 | 10110011 |
| 141 | 10001101 | 123 | 01111011 | 205 | 11001101 | 180 | 10110100 |
| 142 | 10001110 | 124 | 01111100 | 206 | 11001110 | 180 | 10110100 |
| 143 | 10001111 | 125 | 01111101 | 207 | 11001111 | 181 | 10110101 |
| 144 | 10010000 | 126 | 01111110 | 208 | 11010000 | 182 | 10110110 |
| 145 | 10010001 | 127 | 01111111 | 209 | 11010001 | 183 | 10110111 |
| 146 | 10010010 | 128 | 10000000 | 210 | 11010010 | 184 | 10111000 |
| 147 | 10010011 | 129 | 10000001 | 211 | 11010011 | 185 | 10111001 |
| 148 | 10010100 | 130 | 10000010 | 212 | 11010100 | 186 | 10111010 |
| 149 | 10010101 | 130 | 10000010 | 213 | 11010101 | 187 | 10111011 |
| 150 | 10010110 | 131 | 10000011 | 214 | 11010110 | 187 | 10111011 |
| 151 | 10010111 | 132 | 10000100 | 215 | 11010111 | 188 | 10111100 |
| 152 | 10011000 | 133 | 10000101 | 216 | 11011000 | 189 | 10111101 |
| 153 | 10011001 | 134 | 10000110 | 217 | 11011001 | 190 | 10111110 |
| 154 | 10011010 | 135 | 10000111 | 218 | 11011010 | 191 | 10111111 |
| 155 | 10011011 | 136 | 10001000 | 219 | 11011011 | 192 | 11000000 |
| 156 | 10011100 | 137 | 10001001 | 220 | 11011100 | 193 | 11000001 |
| 157 | 10011101 | 137 | 10001001 | 221 | 11011101 | 194 | 11000010 |
| 158 | 10011110 | 138 | 10001010 | 222 | 11011110 | 195 | 11000011 |
| 159 | 10011111 | 139 | 10001011 | 223 | 11011111 | 195 | 11000011 |
| 160 | 10100000 | 140 | 10001100 | 224 | 11100000 | 196 | 11000100 |
| 161 | 10100001 | 141 | 10001101 | 225 | 11100001 | 197 | 11000101 |
| 162 | 10100010 | 142 | 10001110 | 226 | 11100010 | 198 | 11000110 |
| 163 | 10100011 | 143 | 10001111 | 227 | 11100011 | 199 | 11000111 |
| 164 | 10100100 | 144 | 10010000 | 228 | 11100100 | 200 | 11001000 |
| 165 | 10100101 | 144 | 10010000 | 229 | 11100101 | 201 | 11001001 |
| 166 | 10100110 | 145 | 10010001 | 230 | 11100110 | 202 | 11001010 |
| 167 | 10100111 | 146 | 10010010 | 231 | 11100111 | 202 | 11001010 |
| 168 | 10101000 | 147 | 10010011 | 232 | 11101000 | 203 | 11001011 |
| 169 | 10101001 | 148 | 10010100 | 233 | 11101001 | 204 | 11001100 |
| 170 | 10101010 | 149 | 10010101 | 234 | 11101010 | 205 | 11001101 |
| 171 | 10101011 | 150 | 10010110 | 235 | 11101011 | 206 | 11001110 |
| 172 | 10101100 | 151 | 10010111 | 236 | 11101100 | 207 | 11001111 |
| 173 | 10101101 | 151 | 10010111 | 237 | 11101101 | 208 | 11010000 |
| 174 | 10101110 | 152 | 10011000 | 238 | 11101110 | 209 | 11010001 |
| 175 | 10101111 | 153 | 10011001 | 239 | 11101111 | 209 | 11010001 |
| 176 | 10110000 | 154 | 10011010 | 240 | 11110000 | 210 | 11010010 |
| 177 | 10110001 | 155 | 10011011 | 241 | 11110001 | 211 | 11010011 |
| 178 | 10110010 | 156 | 10011100 | 242 | 11110010 | 212 | 11010100 |
| 179 | 10110011 | 157 | 10011101 | 243 | 11110011 | 213 | 11010101 |
| 180 | 10110100 | 158 | 10011110 | 244 | 11110100 | 214 | 11010110 |
| 181 | 10110101 | 158 | 10011110 | 245 | 11110101 | 215 | 11010111 |
| 182 | 10110110 | 159 | 10011111 | 246 | 11110110 | 216 | 11011000 |
| 183 | 10110111 | 160 | 10100000 | 247 | 11110111 | 216 | 11011000 |
| 184 | 10111000 | 161 | 10100001 | 248 | 11111000 | 217 | 11011001 |
| 185 | 10111001 | 162 | 10100010 | 249 | 11111001 | 218 | 11011010 |
| 186 | 10111010 | 163 | 10100011 | 250 | 11111010 | 219 | 11011011 |
| 187 | 10111011 | 164 | 10100100 | 251 | 11111011 | 220 | 11011100 |
| 188 | 10111100 | 165 | 10100101 | 252 | 11111100 | 221 | 11011101 |
| 189 | 10111101 | 166 | 10100110 | 253 | 11111101 | 222 | 11011110 |
| 190 | 10111110 | 166 | 10100110 | 254 | 11111110 | 223 | 11011111 |
| 191 | 10111111 | 167 | 10100111 | 255 | 11111111 | 224 | 1110000 |

FIG.13

FIRST EMISSION DRIVING GRAYSCALE

EMISSION BRIGHTNESS

| | DATA CONVERSION TABLE FOR SECOND DATA CONVERSION CIRCUIT 34 | | | | | | | | | | | | | | | EMISSION DRIVING PATTERN IN ONE FIELD | | | | | | | | | | | | | | |
|---|---|---|---|---|---|---|---|---|---|---|---|---|---|---|---|---|---|---|---|---|---|---|---|---|---|---|---|---|---|---|
| | Ds | GDa 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| 1 | 0000 | 1 | 0 | 0 | 0 | 0 | 0 | 0 | 0 | 0 | 0 | 0 | 0 | 0 | 0 | ● | | | | | | | | | | | | | | 0 |
| 2 | 0001 | 0 | 1 | 0 | 0 | 0 | 0 | 0 | 0 | 0 | 0 | 0 | 0 | 0 | 0 | ○ | ● | | | | | | | | | | | | | 1 |
| 3 | 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 4 | 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 5 | 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 6 | 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 7 | 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 8 | 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 9 | 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 10 | 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 11 | 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 12 | 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 13 | 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 14 | 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 15 | 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

BLACK CIRCLES : SELECTIVE ERASING DISCHARGE
WHITE CIRCLES : SUSTAINING DISCHARGE EMISSION

FIG.14

SECOND EMISSION DRIVING GRAYSCALE

EMISSION BRIGHTNESS

| | DATA CONVERSION TABLE FOR SECOND DATA CONVERSION CIRCUIT 35 | | | | | | | | | | | | | | | EMISSION DRIVING PATTERN IN ONE FIELD | | | | | | | | | | | | | | |
|---|---|---|---|---|---|---|---|---|---|---|---|---|---|---|---|---|---|---|---|---|---|---|---|---|---|---|---|---|---|---|
| | Ds | GDb 1 | 2 | 3 | 4 | 5 | 6 | 7 | 8 | 9 | 10 | 11 | 12 | 13 | 14 | SF 1 | SF 3 | SF 5 | SF 7 | SF 9 | SF 11 | SF 13 | SF 2 | SF 4 | SF 6 | SF 8 | SF 10 | SF 12 | SF 14 | |
| 1 | 0000 | 1 | 0 | 0 | 0 | 0 | 0 | 0 | 1 | 0 | 0 | 0 | 0 | 0 | 0 | ● | | | | | | | ● | | | | | | | 0 |
| 2 | 0001 | 0 | 1 | 0 | 0 | 0 | 0 | 0 | 1 | 0 | 0 | 0 | 0 | 0 | 0 | ○ | ● | | | | | | ● | | | | | | | 1 |
| 3 | 0010 | 0 | 1 | 0 | 0 | 0 | 0 | 0 | 0 | 1 | 0 | 0 | 0 | 0 | 0 | ○ | ● | | | | | | ○ | ● | | | | | | 4 |
| 4 | 0011 | 0 | 0 | 1 | 0 | 0 | 0 | 0 | 0 | 1 | 0 | 0 | 0 | 0 | 0 | ○ | ○ | ● | | | | | ○ | ● | | | | | | 9 |
| 5 | 0100 | 0 | 0 | 1 | 0 | 0 | 0 | 0 | 0 | 0 | 1 | 0 | 0 | 0 | 0 | ○ | ○ | ● | | | | | ○ | ○ | ● | | | | | 17 |
| 6 | 0101 | 0 | 0 | 0 | 1 | 0 | 0 | 0 | 0 | 0 | 1 | 0 | 0 | 0 | 0 | ○ | ○ | ○ | ● | | | | ○ | ○ | ● | | | | | 27 |
| 7 | 0110 | 0 | 0 | 0 | 1 | 0 | 0 | 0 | 0 | 0 | 0 | 1 | 0 | 0 | 0 | ○ | ○ | ○ | ● | | | | ○ | ○ | ○ | ● | | | | 40 |
| 8 | 0111 | 0 | 0 | 0 | 0 | 1 | 0 | 0 | 0 | 0 | 0 | 1 | 0 | 0 | 0 | ○ | ○ | ○ | ○ | ● | | | ○ | ○ | ○ | ● | | | | 56 |
| 9 | 1000 | 0 | 0 | 0 | 0 | 1 | 0 | 0 | 0 | 0 | 0 | 0 | 1 | 0 | 0 | ○ | ○ | ○ | ○ | ● | | | ○ | ○ | ○ | ○ | ● | | | 75 |
| 10 | 1001 | 0 | 0 | 0 | 0 | 0 | 1 | 0 | 0 | 0 | 0 | 0 | 1 | 0 | 0 | ○ | ○ | ○ | ○ | ○ | ● | | ○ | ○ | ○ | ○ | ● | | | 97 |
| 11 | 1010 | 0 | 0 | 0 | 0 | 0 | 1 | 0 | 0 | 0 | 0 | 0 | 0 | 1 | 0 | ○ | ○ | ○ | ○ | ○ | ● | | ○ | ○ | ○ | ○ | ○ | ● | | 122 |
| 12 | 1011 | 0 | 0 | 0 | 0 | 0 | 0 | 1 | 0 | 0 | 0 | 0 | 0 | 1 | 0 | ○ | ○ | ○ | ○ | ○ | ○ | ● | ○ | ○ | ○ | ○ | ○ | ● | | 150 |
| 13 | 1100 | 0 | 0 | 0 | 0 | 0 | 0 | 1 | 0 | 0 | 0 | 0 | 0 | 0 | 1 | ○ | ○ | ○ | ○ | ○ | ○ | ● | ○ | ○ | ○ | ○ | ○ | ○ | ● | 182 |
| 14 | 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 15 | 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

BLACK CIRCLES : SELECTIVE ERASING DISCHARGE
WHITE CIRCLES : SUSTAINING DISCHARGE EMISSION

FIG.18

SECOND EMISSION DRIVING GRAYSCALE

EMISSION BRIGHTNESS

| | DATA CONVERSION TABLE FOR SECOND DATA CONVERSION CIRCUIT 35 | | | | | | | | | | | | | | | EMISSION DRIVING PATTERN IN ONE FIELD | | | | | | | | | | | | | | |
|---|---|---|---|---|---|---|---|---|---|---|---|---|---|---|---|---|---|---|---|---|---|---|---|---|---|---|---|---|---|---|
| | Ds | GDb 1 | 2 | 3 | 4 | 5 | 6 | 7 | 8 | 9 | 10 | 11 | 12 | 13 | 14 | SF 1 | SF 3 | SF 5 | SF 7 | SF 9 | SF 11 | SF 13 | SF 2 | SF 4 | SF 6 | SF 8 | SF 10 | SF 12 | SF 14 | |
| 1 | 0000 | 1 | 1 | 0 | 0 | 0 | 0 | 0 | 1 | 1 | 0 | 0 | 0 | 0 | 0 | ● | ● | | | | | | ● | ● | | | | | | 0 |
| 2 | 0001 | 0 | 1 | 1 | 0 | 0 | 0 | 0 | 1 | 1 | 0 | 0 | 0 | 0 | 0 | ○ | ● | ● | | | | | ● | ● | | | | | | 1 |
| 3 | 0010 | 0 | 1 | 1 | 0 | 0 | 0 | 0 | 0 | 1 | 1 | 0 | 0 | 0 | 0 | ○ | ● | ● | | | | | ○ | ● | ● | | | | | 4 |
| 4 | 0011 | 0 | 0 | 1 | 1 | 0 | 0 | 0 | 0 | 1 | 1 | 0 | 0 | 0 | 0 | ○ | ○ | ● | ● | | | | ○ | ● | ● | | | | | 9 |
| 5 | 0100 | 0 | 0 | 1 | 1 | 0 | 0 | 0 | 0 | 0 | 1 | 1 | 0 | 0 | 0 | ○ | ○ | ● | ● | | | | ○ | ○ | ● | ● | | | | 17 |
| 6 | 0101 | 0 | 0 | 0 | 1 | 1 | 0 | 0 | 0 | 0 | 1 | 1 | 0 | 0 | 0 | ○ | ○ | ○ | ● | ● | | | ○ | ○ | ● | ● | | | | 27 |
| 7 | 0110 | 0 | 0 | 0 | 1 | 1 | 0 | 0 | 0 | 0 | 0 | 1 | 1 | 0 | 0 | ○ | ○ | ○ | ● | ● | | | ○ | ○ | ○ | ● | ● | | | 40 |
| 8 | 0111 | 0 | 0 | 0 | 0 | 1 | 1 | 0 | 0 | 0 | 0 | 1 | 1 | 0 | 0 | ○ | ○ | ○ | ○ | ● | ● | | ○ | ○ | ○ | ● | ● | | | 56 |
| 9 | 1000 | 0 | 0 | 0 | 0 | 1 | 1 | 0 | 0 | 0 | 0 | 0 | 1 | 1 | 0 | ○ | ○ | ○ | ○ | ● | ● | | ○ | ○ | ○ | ○ | ● | ● | | 75 |
| 10 | 1001 | 0 | 0 | 0 | 0 | 0 | 1 | 1 | 0 | 0 | 0 | 0 | 1 | 1 | 0 | ○ | ○ | ○ | ○ | ○ | ● | ● | ○ | ○ | ○ | ○ | ● | ● | | 97 |
| 11 | 1010 | 0 | 0 | 0 | 0 | 0 | 1 | 1 | 0 | 0 | 0 | 0 | 0 | 1 | 1 | ○ | ○ | ○ | ○ | ○ | ● | ● | ○ | ○ | ○ | ○ | ○ | ● | ● | 122 |
| 12 | 1011 | 0 | 0 | 0 | 0 | 0 | 0 | 1 | 0 | 0 | 0 | 0 | 0 | 1 | 1 | ○ | ○ | ○ | ○ | ○ | ○ | ● | ○ | ○ | ○ | ○ | ○ | ● | ● | 150 |
| 13 | 1100 | 0 | 0 | 0 | 0 | 0 | 0 | 1 | 0 | 0 | 0 | 0 | 0 | 0 | 1 | ○ | ○ | ○ | ○ | ○ | ○ | ● | ○ | ○ | ○ | ○ | ○ | ○ | ● | 182 |
| 14 | 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 15 | 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

BLACK CIRCLES : SELECTIVE ERASING DISCHARGE
WHITE CIRCLES : SUSTAINING DISCHARGE EMISSION

FIG. 20

SECOND EMISSION DRIVING GRAYSCALE

EMISSION BRIGHTNESS

| | DATA CONVERSION TABLE FOR SECOND DATA CONVERSION CIRCUIT 35 | | | | | | | | | | | | | | | EMISSION DRIVING PATTERN IN ONE FIELD | | | | | | | | | | | | | | |
|---|---|---|---|---|---|---|---|---|---|---|---|---|---|---|---|---|---|---|---|---|---|---|---|---|---|---|---|---|---|---|
| | Ds | GDb 1 | 2 | 3 | 4 | 5 | 6 | 7 | 8 | 9 | 10 | 11 | 12 | 13 | 14 | SF 1 | SF 4 | SF 5 | SF 8 | SF 9 | SF 12 | SF 13 | SF 2 | SF 3 | SF 6 | SF 7 | SF 10 | SF 11 | SF 14 | |
| 1 | 0000 | 1 | 0 | 0 | 0 | 0 | 0 | 0 | 1 | 0 | 0 | 0 | 0 | 0 | 0 | ● | | | | | | | ● | | | | | | | 0 |
| 2 | 0001 | 0 | 1 | 0 | 0 | 0 | 0 | 0 | 1 | 0 | 0 | 0 | 0 | 0 | 0 | ○ | ● | | | | | | ● | | | | | | | 1 |
| 3 | 0010 | 0 | 1 | 0 | 0 | 0 | 0 | 0 | 0 | 1 | 0 | 0 | 0 | 0 | 0 | ○ | ● | | | | | | ○ | ● | | | | | | 4 |
| 4 | 0011 | 0 | 1 | 0 | 0 | 0 | 0 | 0 | 0 | 0 | 1 | 0 | 0 | 0 | 0 | ○ | ● | | | | | | ○ | ○ | ● | | | | | 9 |
| 5 | 0100 | 0 | 0 | 1 | 0 | 0 | 0 | 0 | 0 | 0 | 1 | 0 | 0 | 0 | 0 | ○ | ○ | ● | | | | | ○ | ○ | ● | | | | | 17 |
| 6 | 0101 | 0 | 0 | 0 | 1 | 0 | 0 | 0 | 0 | 0 | 1 | 0 | 0 | 0 | 0 | ○ | ○ | ○ | ● | | | | ○ | ○ | ● | | | | | 27 |
| 7 | 0110 | 0 | 0 | 0 | 1 | 0 | 0 | 0 | 0 | 0 | 0 | 1 | 0 | 0 | 0 | ○ | ○ | ○ | ● | | | | ○ | ○ | ○ | ● | | | | 40 |
| 8 | 0111 | 0 | 0 | 0 | 1 | 0 | 0 | 0 | 0 | 0 | 0 | 0 | 1 | 0 | 0 | ○ | ○ | ○ | ● | | | | ○ | ○ | ○ | ○ | ● | | | 56 |
| 9 | 1000 | 0 | 0 | 0 | 0 | 1 | 0 | 0 | 0 | 0 | 0 | 0 | 1 | 0 | 0 | ○ | ○ | ○ | ○ | ● | | | ○ | ○ | ○ | ○ | ● | | | 75 |
| 10 | 1001 | 0 | 0 | 0 | 0 | 0 | 1 | 0 | 0 | 0 | 0 | 0 | 1 | 0 | 0 | ○ | ○ | ○ | ○ | ○ | ● | | ○ | ○ | ○ | ○ | ● | | | 97 |
| 11 | 1010 | 0 | 0 | 0 | 0 | 0 | 1 | 0 | 0 | 0 | 0 | 0 | 0 | 1 | 0 | ○ | ○ | ○ | ○ | ○ | ● | | ○ | ○ | ○ | ○ | ○ | ● | | 122 |
| 12 | 1011 | 0 | 0 | 0 | 0 | 0 | 1 | 0 | 0 | 0 | 0 | 0 | 0 | 0 | 1 | ○ | ○ | ○ | ○ | ○ | ● | | ○ | ○ | ○ | ○ | ○ | ○ | ● | 150 |
| 13 | 1100 | 0 | 0 | 0 | 0 | 0 | 0 | 1 | 0 | 0 | 0 | 0 | 0 | 0 | 1 | ○ | ○ | ○ | ○ | ○ | ○ | ● | ○ | ○ | ○ | ○ | ○ | ○ | ● | 182 |
| 14 | 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 15 | 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

BLACK CIRCLES : SELECTIVE ERASING DISCHARGE
WHITE CIRCLES : SUSTAINING DISCHARGE EMISSION

FIG.23

FIRST EMISSION DRIVING GRAYSCALE

EMISSION BRIGHTNESS

| | DATA CONVERSION TABLE FOR SECOND DATA CONVERSION CIRCUIT 34 | | | | | | | | | | | | | | | EMISSION DRIVING PATTERN IN ONE FIELD | | | | | | | | | | | | | | |
|---|---|---|---|---|---|---|---|---|---|---|---|---|---|---|---|---|---|---|---|---|---|---|---|---|---|---|---|---|---|---|
| | Ds | GDa 14 | 13 | 12 | 11 | 10 | 9 | 8 | 7 | 6 | 5 | 4 | 3 | 2 | 1 | SF 14 | SF 13 | SF 12 | SF 11 | SF 10 | SF 9 | SF 8 | SF 7 | SF 6 | SF 5 | SF 4 | SF 3 | SF 2 | SF 1 | |
| 1 | 0000 | 0 | 0 | 0 | 0 | 0 | 0 | 0 | 0 | 0 | 0 | 0 | 0 | 0 | 0 | | | | | | | | | | | | | | | 0 |
| 2 | 0001 | 0 | 0 | 0 | 0 | 0 | 0 | 0 | 0 | 0 | 0 | 0 | 0 | 0 | 1 | | | | | | | | | | | | | | ● | 1 |
| 3 | 0010 | 0 | 0 | 0 | 0 | 0 | 0 | 0 | 0 | 0 | 0 | 0 | 0 | 1 | 0 | | | | | | | | | | | | | ● | ○ | 4 |
| 4 | 0011 | 0 | 0 | 0 | 0 | 0 | 0 | 0 | 0 | 0 | 0 | 0 | 1 | 0 | 0 | | | | | | | | | | | | ● | ○ | ○ | 9 |
| 5 | 0100 | 0 | 0 | 0 | 0 | 0 | 0 | 0 | 0 | 0 | 0 | 1 | 0 | 0 | 0 | | | | | | | | | | | ● | ○ | ○ | ○ | 17 |
| 6 | 0101 | 0 | 0 | 0 | 0 | 0 | 0 | 0 | 0 | 0 | 1 | 0 | 0 | 0 | 0 | | | | | | | | | | ● | ○ | ○ | ○ | ○ | 27 |
| 7 | 0110 | 0 | 0 | 0 | 0 | 0 | 0 | 0 | 0 | 1 | 0 | 0 | 0 | 0 | 0 | | | | | | | | | ● | ○ | ○ | ○ | ○ | ○ | 40 |
| 8 | 0111 | 0 | 0 | 0 | 0 | 0 | 0 | 0 | 1 | 0 | 0 | 0 | 0 | 0 | 0 | | | | | | | | ● | ○ | ○ | ○ | ○ | ○ | ○ | 56 |
| 9 | 1000 | 0 | 0 | 0 | 0 | 0 | 0 | 1 | 0 | 0 | 0 | 0 | 0 | 0 | 0 | | | | | | | ● | ○ | ○ | ○ | ○ | ○ | ○ | ○ | 75 |
| 10 | 1001 | 0 | 0 | 0 | 0 | 0 | 1 | 0 | 0 | 0 | 0 | 0 | 0 | 0 | 0 | | | | | | ● | ○ | ○ | ○ | ○ | ○ | ○ | ○ | ○ | 97 |
| 11 | 1010 | 0 | 0 | 0 | 0 | 1 | 0 | 0 | 0 | 0 | 0 | 0 | 0 | 0 | 0 | | | | | ● | ○ | ○ | ○ | ○ | ○ | ○ | ○ | ○ | ○ | 122 |
| 12 | 1011 | 0 | 0 | 0 | 1 | 0 | 0 | 0 | 0 | 0 | 0 | 0 | 0 | 0 | 0 | | | | ● | ○ | ○ | ○ | ○ | ○ | ○ | ○ | ○ | ○ | ○ | 150 |
| 13 | 1100 | 0 | 0 | 1 | 0 | 0 | 0 | 0 | 0 | 0 | 0 | 0 | 0 | 0 | 0 | | | ● | ○ | ○ | ○ | ○ | ○ | ○ | ○ | ○ | ○ | ○ | ○ | 182 |
| 14 | 1101 | 0 | 1 | 0 | 0 | 0 | 0 | 0 | 0 | 0 | 0 | 0 | 0 | 0 | 0 | | ● | ○ | ○ | ○ | ○ | ○ | ○ | ○ | ○ | ○ | ○ | ○ | ○ | 217 |
| 15 | 1110 | 1 | 0 | 0 | 0 | 0 | 0 | 0 | 0 | 0 | 0 | 0 | 0 | 0 | 0 | ● | ○ | ○ | ○ | ○ | ○ | ○ | ○ | ○ | ○ | ○ | ○ | ○ | ○ | 255 |

BLACK CIRCLES : SELECTIVE ERASING DISCHARGE + SUSTAINING DISCHARGE EMISSION
WHITE CIRCLES : SUSTAINING DISCHARGE EMISSION

FIG.24

SECOND EMISSION DRIVING GRAYSCALE

EMISSION BRIGHTNESS

| | DATA CONVERSION TABLE FOR SECOND DATA CONVERSION CIRCUIT 35 | | | | | | | | | | | | | | | EMISSION DRIVING PATTERN IN ONE FIELD | | | | | | | | | | | | | |
|---|---|---|---|---|---|---|---|---|---|---|---|---|---|---|---|---|---|---|---|---|---|---|---|---|---|---|---|---|---|
| | Ds | GDb 1 | 2 | 3 | 4 | 5 | 6 | 7 | 8 | 9 | 10 | 11 | 12 | 13 | 14 | SF 13 | SF 11 | SF 9 | SF 7 | SF 5 | SF 3 | SF 1 | SF 14 | SF 12 | SF 10 | SF 8 | SF 6 | SF 4 | SF 2 | |
| 1 | 0000 | 0 | 0 | 0 | 0 | 0 | 0 | 0 | 0 | 0 | 0 | 0 | 0 | 0 | 0 | | | | | | | | | | | | | | | 0 |
| 2 | 0001 | 0 | 0 | 0 | 0 | 0 | 0 | 1 | 0 | 0 | 0 | 0 | 0 | 0 | 0 | | | | | | | ● | | | | | | | | 1 |
| 3 | 0010 | 0 | 0 | 0 | 0 | 0 | 0 | 1 | 0 | 0 | 0 | 0 | 0 | 0 | 1 | | | | | | | ● | | | | | | | ● | 4 |
| 4 | 0011 | 0 | 0 | 0 | 0 | 0 | 1 | 0 | 0 | 0 | 0 | 0 | 0 | 0 | 1 | | | | | | ● | ○ | | | | | | | ● | 9 |
| 5 | 0100 | 0 | 0 | 0 | 0 | 0 | 1 | 0 | 0 | 0 | 0 | 0 | 0 | 1 | 0 | | | | | | ● | ○ | | | | | | ● | ○ | 17 |
| 6 | 0101 | 0 | 0 | 0 | 0 | 1 | 0 | 0 | 0 | 0 | 0 | 0 | 0 | 1 | 0 | | | | | ● | ○ | ○ | | | | | | ● | ○ | 27 |
| 7 | 0110 | 0 | 0 | 0 | 0 | 1 | 0 | 0 | 0 | 0 | 0 | 0 | 1 | 0 | 0 | | | | | ● | ○ | ○ | | | | | ● | ○ | ○ | 40 |
| 8 | 0111 | 0 | 0 | 0 | 1 | 0 | 0 | 0 | 0 | 0 | 0 | 0 | 1 | 0 | 0 | | | | ● | ○ | ○ | ○ | | | | | ● | ○ | ○ | 56 |
| 9 | 1000 | 0 | 0 | 0 | 1 | 0 | 0 | 0 | 0 | 0 | 0 | 1 | 0 | 0 | 0 | | | | ● | ○ | ○ | ○ | | | | ● | ○ | ○ | ○ | 75 |
| 10 | 1001 | 0 | 0 | 1 | 0 | 0 | 0 | 0 | 0 | 0 | 0 | 1 | 0 | 0 | 0 | | | ● | ○ | ○ | ○ | ○ | | | | ● | ○ | ○ | ○ | 97 |
| 11 | 1010 | 0 | 0 | 1 | 0 | 0 | 0 | 0 | 0 | 0 | 1 | 0 | 0 | 0 | 0 | | | ● | ○ | ○ | ○ | ○ | | | ● | ○ | ○ | ○ | ○ | 122 |
| 12 | 1011 | 0 | 1 | 0 | 0 | 0 | 0 | 0 | 0 | 0 | 1 | 0 | 0 | 0 | 0 | | ● | ○ | ○ | ○ | ○ | ○ | | | ● | ○ | ○ | ○ | ○ | 150 |
| 13 | 1100 | 0 | 1 | 0 | 0 | 0 | 0 | 0 | 0 | 1 | 0 | 0 | 0 | 0 | 0 | | ● | ○ | ○ | ○ | ○ | ○ | | ● | ○ | ○ | ○ | ○ | ○ | 182 |
| 14 | 1101 | 1 | 0 | 0 | 0 | 0 | 0 | 0 | 0 | 1 | 0 | 0 | 0 | 0 | 0 | ● | ○ | ○ | ○ | ○ | ○ | ○ | | ● | ○ | ○ | ○ | ○ | ○ | 217 |
| 15 | 1110 | 1 | 0 | 0 | 0 | 0 | 0 | 0 | 1 | 0 | 0 | 0 | 0 | 0 | 0 | ● | ○ | ○ | ○ | ○ | ○ | ○ | ● | ○ | ○ | ○ | ○ | ○ | ○ | 255 |

BLACK CIRCLES : SELECTIVE ERASING DISCHARGE + SUSTAINING DISCHARGE EMISSION
WHITE CIRCLES : SUSTAINING DISCHARGE EMISSION

FIG.26

SECOND EMISSION DRIVING GRAYSCALE

EMISSION BRIGHTNESS

| | DATA CONVERSION TABLE FOR SECOND DATA CONVERSION CIRCUIT 35 | | | | | | | | | | | | | | | EMISSION DRIVING PATTERN IN ONE FIELD | | | | | | | | | | | | | | |
|---|---|---|---|---|---|---|---|---|---|---|---|---|---|---|---|---|---|---|---|---|---|---|---|---|---|---|---|---|---|---|
| | Ds | GDb 1 | 2 | 3 | 4 | 5 | 6 | 7 | 8 | 9 | 10 | 11 | 12 | 13 | 14 | SF 2 | SF 4 | SF 6 | SF 8 | SF 10 | SF 12 | SF 14 | SF 1 | SF 3 | SF 5 | SF 7 | SF 9 | SF 11 | SF 13 | |
| 1 | 0000 | 1 | 0 | 0 | 0 | 0 | 0 | 0 | 1 | 0 | 0 | 0 | 0 | 0 | 0 | ● | | | | | | | ● | | | | | | | 0 |
| 2 | 0001 | 1 | 0 | 0 | 0 | 0 | 0 | 0 | 0 | 1 | 0 | 0 | 0 | 0 | 0 | ● | | | | | | | ○ | ● | | | | | | 1 |
| 3 | 0010 | 0 | 1 | 0 | 0 | 0 | 0 | 0 | 0 | 1 | 0 | 0 | 0 | 0 | 0 | ○ | ● | | | | | | ○ | ● | | | | | | 4 |
| 4 | 0011 | 0 | 1 | 0 | 0 | 0 | 0 | 0 | 0 | 0 | 1 | 0 | 0 | 0 | 0 | ○ | ● | | | | | | ○ | ○ | ● | | | | | 9 |
| 5 | 0100 | 0 | 0 | 1 | 0 | 0 | 0 | 0 | 0 | 0 | 1 | 0 | 0 | 0 | 0 | ○ | ○ | ● | | | | | ○ | ○ | ● | | | | | 17 |
| 6 | 0101 | 0 | 0 | 1 | 0 | 0 | 0 | 0 | 0 | 0 | 0 | 1 | 0 | 0 | 0 | ○ | ○ | ● | | | | | ○ | ○ | ○ | ● | | | | 27 |
| 7 | 0110 | 0 | 0 | 0 | 1 | 0 | 0 | 0 | 0 | 0 | 0 | 1 | 0 | 0 | 0 | ○ | ○ | ○ | ● | | | | ○ | ○ | ○ | ● | | | | 40 |
| 8 | 0111 | 0 | 0 | 0 | 1 | 0 | 0 | 0 | 0 | 0 | 0 | 0 | 1 | 0 | 0 | ○ | ○ | ○ | ● | | | | ○ | ○ | ○ | ○ | ● | | | 56 |
| 9 | 1000 | 0 | 0 | 0 | 0 | 1 | 0 | 0 | 0 | 0 | 0 | 0 | 1 | 0 | 0 | ○ | ○ | ○ | ○ | ● | | | ○ | ○ | ○ | ○ | ● | | | 75 |
| 10 | 1001 | 0 | 0 | 0 | 0 | 1 | 0 | 0 | 0 | 0 | 0 | 0 | 0 | 1 | 0 | ○ | ○ | ○ | ○ | ● | | | ○ | ○ | ○ | ○ | ○ | ● | | 97 |
| 11 | 1010 | 0 | 0 | 0 | 0 | 0 | 1 | 0 | 0 | 0 | 0 | 0 | 0 | 1 | 0 | ○ | ○ | ○ | ○ | ○ | ● | | ○ | ○ | ○ | ○ | ○ | ● | | 122 |
| 12 | 1011 | 0 | 0 | 0 | 0 | 0 | 1 | 0 | 0 | 0 | 0 | 0 | 0 | 0 | 1 | ○ | ○ | ○ | ○ | ○ | ● | | ○ | ○ | ○ | ○ | ○ | ○ | ● | 150 |
| 13 | 1100 | 0 | 0 | 0 | 0 | 0 | 0 | 1 | 0 | 0 | 0 | 0 | 0 | 0 | 1 | ○ | ○ | ○ | ○ | ○ | ○ | ● | ○ | ○ | ○ | ○ | ○ | ○ | ● | 182 |
| 14 | 1101 | 0 | 0 | 0 | 0 | 0 | 0 | 1 | 0 | 0 | 0 | 0 | 0 | 0 | 0 | ○ | ○ | ○ | ○ | ○ | ○ | ● | ○ | ○ | ○ | ○ | ○ | ○ | ○ | 217 |
| 15 | 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

BLACK CIRCLES : SELECTIVE ERASING DISCHARGE
WHITE CIRCLES : SUSTAINING DISCHARGE EMISSION

FIG.28

SECOND EMISSION DRIVING GRAYSCALE

EMISSION BRIGHTNESS

| | DATA CONVERSION TABLE FOR SECOND DATA CONVERSION CIRCUIT 35 | | | | | | | | | | | | | | | EMISSION DRIVING PATTERN IN ONE FIELD | | | | | | | | | | | | | | |
|---|---|---|---|---|---|---|---|---|---|---|---|---|---|---|---|---|---|---|---|---|---|---|---|---|---|---|---|---|---|---|
| | Ds | GDb 1 | 2 | 3 | 4 | 5 | 6 | 7 | 8 | 9 | 10 | 11 | 12 | 13 | 14 | SF 14 | SF 12 | SF 10 | SF 8 | SF 6 | SF 4 | SF 2 | SF 13 | SF 11 | SF 9 | SF 7 | SF 5 | SF 3 | SF 1 | |
| 1 | 0000 | 0 | 0 | 0 | 0 | 0 | 0 | 0 | 0 | 0 | 0 | 0 | 0 | 0 | 0 | | | | | | | | | | | | | | | 0 |
| 2 | 0001 | 0 | 0 | 0 | 0 | 0 | 0 | 0 | 0 | 0 | 0 | 0 | 0 | 0 | 1 | | | | | | | | | | | | | | ● | 1 |
| 3 | 0010 | 0 | 0 | 0 | 0 | 0 | 0 | 1 | 0 | 0 | 0 | 0 | 0 | 0 | 1 | | | | | | | ● | | | | | | | ● | 4 |
| 4 | 0011 | 0 | 0 | 0 | 0 | 0 | 0 | 1 | 0 | 0 | 0 | 0 | 0 | 1 | 0 | | | | | | | ● | | | | | | ● | ○ | 9 |
| 5 | 0100 | 0 | 0 | 0 | 0 | 0 | 1 | 0 | 0 | 0 | 0 | 0 | 0 | 1 | 0 | | | | | | ● | ○ | | | | | | ● | ○ | 17 |
| 6 | 0101 | 0 | 0 | 0 | 0 | 0 | 1 | 0 | 0 | 0 | 0 | 0 | 1 | 0 | 0 | | | | | | ● | ○ | | | | | ● | ○ | ○ | 27 |
| 7 | 0110 | 0 | 0 | 0 | 0 | 1 | 0 | 0 | 0 | 0 | 0 | 0 | 1 | 0 | 0 | | | | | ● | ○ | ○ | | | | | ● | ○ | ○ | 40 |
| 8 | 0111 | 0 | 0 | 0 | 0 | 1 | 0 | 0 | 0 | 0 | 0 | 1 | 0 | 0 | 0 | | | | | ● | ○ | ○ | | | | ● | ○ | ○ | ○ | 56 |
| 9 | 1000 | 0 | 0 | 0 | 1 | 0 | 0 | 0 | 0 | 0 | 0 | 1 | 0 | 0 | 0 | | | | ● | ○ | ○ | ○ | | | | ● | ○ | ○ | ○ | 75 |
| 10 | 1001 | 0 | 0 | 0 | 1 | 0 | 0 | 0 | 0 | 0 | 1 | 0 | 0 | 0 | 0 | | | | ● | ○ | ○ | ○ | | | ● | ○ | ○ | ○ | ○ | 97 |
| 11 | 1010 | 0 | 0 | 1 | 0 | 0 | 0 | 0 | 0 | 0 | 1 | 0 | 0 | 0 | 0 | | | ● | ○ | ○ | ○ | ○ | | | ● | ○ | ○ | ○ | ○ | 122 |
| 12 | 1011 | 0 | 0 | 1 | 0 | 0 | 0 | 0 | 0 | 1 | 0 | 0 | 0 | 0 | 0 | | | ● | ○ | ○ | ○ | ○ | | ● | ○ | ○ | ○ | ○ | ○ | 150 |
| 13 | 1100 | 0 | 1 | 0 | 0 | 0 | 0 | 0 | 0 | 1 | 0 | 0 | 0 | 0 | 0 | | ● | ○ | ○ | ○ | ○ | ○ | | ● | ○ | ○ | ○ | ○ | ○ | 182 |
| 14 | 1101 | 0 | 1 | 0 | 0 | 0 | 0 | 0 | 1 | 0 | 0 | 0 | 0 | 0 | 0 | | ● | ○ | ○ | ○ | ○ | ○ | ● | ○ | ○ | ○ | ○ | ○ | ○ | 217 |
| 15 | 1110 | 1 | 0 | 0 | 0 | 0 | 0 | 0 | 1 | 0 | 0 | 0 | 0 | 0 | 0 | ● | ○ | ○ | ○ | ○ | ○ | ○ | ● | ○ | ○ | ○ | ○ | ○ | ○ | 255 |

BLACK CIRCLES : SELECTIVE ERASING DISCHARGE + SUSTAINING DISCHARGE EMISSION
WHITE CIRCLES : SUSTAINING DISCHARGE EMISSION

FIG. 29

SECOND EMISSION DRIVING

| GRAYSCALE | EMISSION DRIVING PATTERN IN ONE FIELD | | | | | | | | | | | | |
|---|---|---|---|---|---|---|---|---|---|---|---|---|---|
| | SF 1 | SF 3 | SF 5 | SF 7 | SF 9 | SF 11 | SF 13 | SF 2 | SF 4 | SF 6 | SF 8 | SF 10 | SF 12 |
| 1 | ● | | | | | | | ● | | | | | |
| 2 | ○ | ● | | | | | | ● | | | | | |
| 3 | ○ | ● | | | | | | ○ | ● | | | | |
| 4 | ○ | ○ | ● | | | | | ○ | ● | | | | |
| 5 | ○ | ○ | ● | | | | | ○ | ○ | ● | | | |
| 6 | ○ | ○ | ○ | ● | | | | ○ | ○ | ● | | | |
| 7 | ○ | ○ | ○ | ● | | | | ○ | ○ | ○ | ● | | |
| 8 | ○ | ○ | ○ | ○ | ● | | | ○ | ○ | ○ | ● | | |
| 9 | ○ | ○ | ○ | ○ | ● | | | ○ | ○ | ○ | ○ | ● | |
| 10 | ○ | ○ | ○ | ○ | ○ | ● | | ○ | ○ | ○ | ○ | ● | |
| 11 | ○ | ○ | ○ | ○ | ○ | ● | | ○ | ○ | ○ | ○ | ○ | ● |
| 12 | ○ | ○ | ○ | ○ | ○ | ○ | ● | ○ | ○ | ○ | ○ | ○ | ● |
| 13 | ○ | ○ | ○ | ○ | ○ | ○ | ● | ○ | ○ | ○ | ○ | ○ | ○ |
| 14 | ○ | ○ | ○ | ○ | ○ | ○ | ○ | ○ | ○ | ○ | ○ | ○ | ○ |

BLACK CIRCLES : SELECTIVE ERASING DISCHARGE
WHITE CIRCLES : SUSTAINING DISCHARGE EMISSION

FIG. 30

SECOND EMISSION DRIVING

| GRAYSCALE | EMISSION DRIVING PATTERN IN ONE FIELD | | | | | | | | | | | | |
|---|---|---|---|---|---|---|---|---|---|---|---|---|---|
| | SF 13 | SF 11 | SF 9 | SF 7 | SF 5 | SF 3 | SF 1 | SF 12 | SF 10 | SF 8 | SF 6 | SF 4 | SF 2 |
| 1 | | | | | | | | | | | | | |
| 2 | | | | | | | ● | | | | | | |
| 3 | | | | | | | ● | | | | | | ● |
| 4 | | | | | | ● | ○ | | | | | | ● |
| 5 | | | | | | ● | ○ | | | | | ● | ○ |
| 6 | | | | | ● | ○ | ○ | | | | | ● | ○ |
| 7 | | | | | ● | ○ | ○ | | | | ● | ○ | ○ |
| 8 | | | | ● | ○ | ○ | ○ | | | | ● | ○ | ○ |
| 9 | | | | ● | ○ | ○ | ○ | | | ● | ○ | ○ | ○ |
| 10 | | | ● | ○ | ○ | ○ | ○ | | | ● | ○ | ○ | ○ |
| 11 | | | ● | ○ | ○ | ○ | ○ | | ● | ○ | ○ | ○ | ○ |
| 12 | | ● | ○ | ○ | ○ | ○ | ○ | | ● | ○ | ○ | ○ | ○ |
| 13 | | ● | ○ | ○ | ○ | ○ | ○ | ● | ○ | ○ | ○ | ○ | ○ |
| 14 | ● | ○ | ○ | ○ | ○ | ○ | ○ | ● | ○ | ○ | ○ | ○ | ○ |

BLACK CIRCLES : SELECTIVE ERASING DISCHARGE + SUSTAINING DISCHARGE EMISSION

WHITE CIRCLES : SUSTAINING DISCHARGE EMISSION

DISPLAY PANEL DRIVING METHOD WITH SELECTABLE DRIVING PATTERN

BACKGROUND OF THE INVENTION

1. Field of the Invention

This invention relates to a method for driving a display panel in which are arranged light emission (hereinafter, simply referred to as "emission") elements having only two states, emitting and non-emitting.

2. Description of the Related Art

With the rend toward display device with larger screens in recent years, displays with thinner shapes have been sought. AC-discharge type plasma display panels have attracted attention as one thin-type display device.

FIG. 1 shows in summary the configuration of a plasma display device equipped with such a plasma display panel.

In FIG. 1, the plasma display panel PDP 10 comprises m column electrodes $D_1$ to $D_m$, as data electrodes, and n row electrodes $X_1$ to $X_n$ and $Y_1$ to $Y_n$, arranged to intersect each of the column electrodes. Each of the pairs X and Y of row electrodes corresponds to a row of the screen. These column electrodes D and row electrodes X and Y are formed on two glass substrate s, arranged in opposition and enclosing a discharge space into which is injected a discharge gas. At the portions of intersection of each of the row electrodes and column electrodes, discharge cells serving as display elements corresponding to individual pixels are formed.

Because the discharge cells utilize a discharge phenomenon, they have only two states, "emitting" and "non-emitting". That is, discharge cells are capable of representing only the brightnesses of two grayscales, at the minimum brightness (the non-emitting state) and at the maximum brightness (the emitting state). The driving device 100 executes grayscale driving of the above PDP 10, in which such discharge cells are arranged in a matrix shape, using a subfield method in which intermediate grayscale brightnesses corresponding to input image signals are represented.

In the subfield method, the display interval for one subfield is divided into, for example, eight subfields SF1 to SF8, as shown in FIG. 2. To each of these subfields SF1 to SF8 is allocate d a number of times emission is to be executed within that subfield. Hence by changing the combination of the subfields during which emission is executed and the subfields during which emission is not executed based on the input image signal, emission is executed, within the display interval of one field, a number of times corresponding to the brightness level of the input image signal. As a result, an intermediate brightness is perceived corresponding to the total number of emissions executed within the field display interval in question.

FIG. 3 is a figure showing one example of emission driving pattern is, indicating combinations of subfields for which emission is executed and subfields for which emission is not executed.

The driving device 100 selects one emission driving pattern from among the nine types shown in FIG. 3, according to the input image signal. The different driving pulses are applied to the column electrodes D and row electrodes X and Y of the PDP 10 so as to execute emission for the number of times shown in FIG. 2 only in those subfields indicated by white circles in the selected emission driving pattern.

Through the nine types of emission driving patterns shown in FIG. 3, images can be displayed having nine intermediate brightnesses, with emission brightness ratios of 0, 1, 7, 23, 47, 82, 128, 185, and 255.

Here, by means of the emission driving patterns shown in FIG. 3, after first putting a discharge cell in the non-emitting state in one subfield within a field interval, emission is not executed again in subsequent subfields. That is, as indicated by the white circles, emission driving patterns wherein subfields in which emission is executed continuously (hereafter called the "continuous emission state") and subfields in which the extinguished state is continuous (hereafter called the "continuous extinguished state") alternate within a single field interval are excluded. As a result, so-called false contours, occurring on the boundaries of two image regions in which the above continuous emission state and the above continuous extinguished state alternate, is suppressed.

In an emission driving pattern like that shown in FIG. 3, the frequency of switching between the above continuous emission state and the above continuous extinguished state is equal to the vertical sync frequency which determines the display interval for a single field. Hence there is concern that when a PAL television signal, which has only a 50 Hz vertical sync frequency, may be supplied as the input image signal, and when the brightness levels represented by this image signal are comparatively high, flicker may occur.

SUMMARY OF THE INVENTION

The present invention was devised in consideration of this problem, and has as an object the provision of a display panel driving method which is capable of image display with false contours suppressed, without the occurrence of flicker even when the vertical sync frequency of the input image signal is low.

The display panel driving method of this invention is a method for driving a display panel in which, in a display panel which forms a display screen by means of a plurality of emission elements, each of the above emission elements is driven to emit light in each of N subfields constituting one field interval of an input image signal. In this method, depending on the vertical sync frequency of the above input image signal and the mean image brightness represented by the above input image signal, either a first emission driving sequence is executed, in which intermediate brightnesses are represented for each of N+1 gradations, from the first grayscale to the (N+1)th grayscale, by causing the above emission elements to emit in n (where n is an integer from 0 to N) of the above subfields which are continuous within the above one field interval, corresponding to the brightness level represented by the above input image signal; or, a second emission driving sequence is executed, in which intermediate brightnesses are represented for each of N+1 gradations, from the first grayscale to the (N+1)th grayscale, by using the above emission elements to emit during the first half of the above field period in each of the above subfields which are continuous, corresponding to the brightness level represented by the above input image signal, and then, in the second half of the field period, causing the above emission elements to emit in each of the above subfields which are continuous, corresponding to the brightness level represented by the above input image signal.

BRIEF DESCRIPTION OF THE DRAWINGS

FIG. 3 is a figure showing one example of an emission driving pattern;

FIG. 7 is a figure showing one example of a data conversion table, based on the data conversion characteristic shown in FIG. 6;

FIG. 8 is a figure showing one example of a data conversion table, based on the data conversion characteristic shown in FIG. 6;

FIG. 13 is a figure showing a data conversion table used in the second data conversion circuit 34, and an emission driving pattern;

FIG. 14 is a figure showing a data conversion table used in the second data conversion circuit 35, and an emission driving pattern;

FIG. 18 is a figure showing the data conversion table used in the second data conversion circuit 35, and another example of an emission driving pattern;

FIG. 20 is a figure showing the data conversion table used in the second data conversion circuit 35, and another example of an emission driving pattern;

FIG. 23 is a figure showing the data conversion table used in the second data conversion circuit 34 when performing the first emission driving based on the emission driving format shown in FIG. 21, and the emission driving pattern;

FIG. 24 is a figure showing the data conversion table used in the second data conversion circuit 35 when performing the second emission driving based on the emission driving format shown in FIG. 22, and the emission driving pattern;

FIG. 26 is a figure showing the data conversion table used in the second data conversion circuit 35 when performing driving based on the emission driving format shown in FIG. 25, and the emission driving pattern;

FIG. 28 is a figure showing the data conversion table used by the second data conversion circuit 35 when performing driving based on the emission driving format shown in FIG. 27, and the emission driving pattern;

FIG. 29 is a figure showing an example of the emission driving pattern adopted when one field is divided into 13 subfields, and grayscale driving is executed based on the selective erasing address method; and, FIG. 30 is a figure showing an example of the emission driving pattern adopted when one field is divided into 13 subfields, and grayscale driving is executed based on the selected writing address method.

DESCRIPTION OF THE PREFERRED EMBODIMENTS

Figure 1:
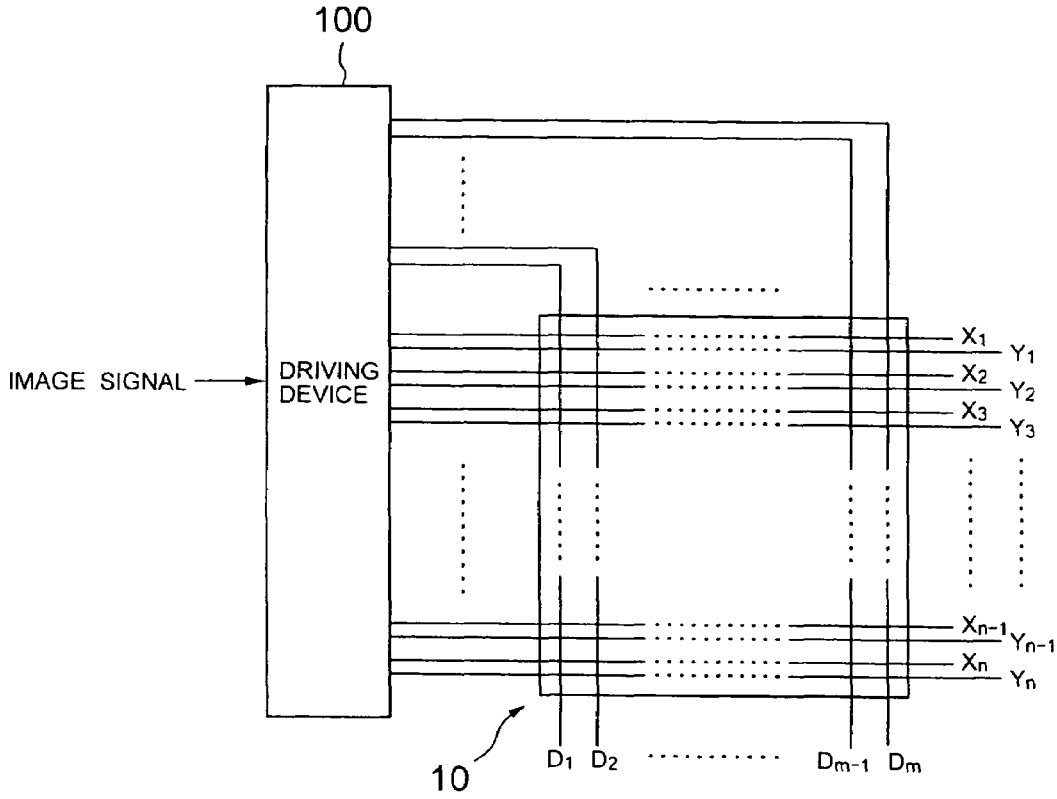
FIG. 1 PRIOR ART
FIG. 1 is a figure showing in summary the configuration of a plasma display device.
Figure 2:
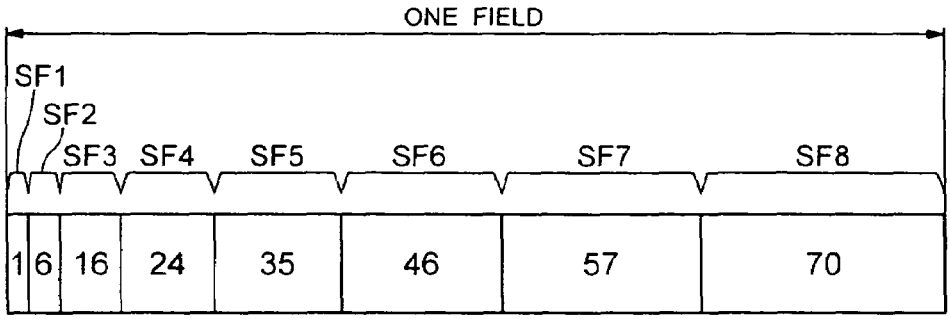
FIG. 2 PRIOR ART
FIG. 2 is a figure showing one example of an emission driving format, based on the subfield method.

Below, embodiments of this invention are explained, referring to the drawings.

Figure 4:
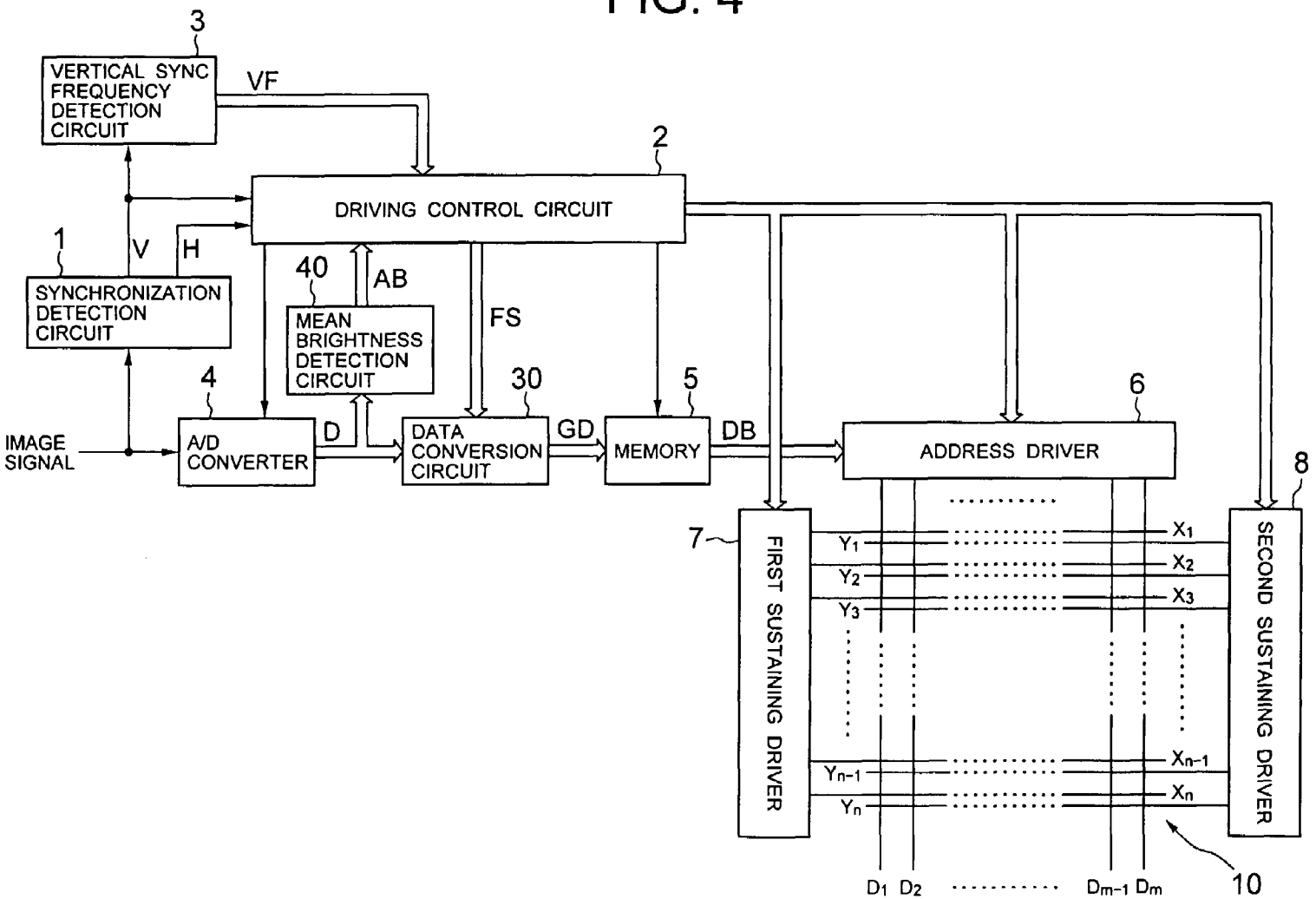
FIG. 4 is a figure showing the configuration of a plasma display device which drives a plasma display panel according to a driving method of this invention.

FIG. 4 is a figure showing the configuration of a plasma display device which drives a plasma display panel according to a driving method of this invention.

As shown in FIG. 4, this plasma display device comprises a plasma display panel PDP 10, and driving circuitry, comprising functional modules as described below. As shown in FIG. 4, the driving circuitry comprises a synchronization detection circuit 1; driving control circuit 2; vertical sync frequency detection circuit 3; A/D converter 4; memory 5; address driver 6; first sustaining driver 7; second sustaining driver 8; data conversion circuit 30; and mean brightness detection circuit 40.

The PDP 10 comprises m column electrodes $D_1$ to $D_m$ as address electrodes, and n each row electrodes $X_1$ to $X_n$ and $Y_1$ to $Y_n$ arranged to intersect each of the column electrodes. Here, row electrodes corresponding to one row in the PDP 10 are formed by one pair of the row electrodes X and Y. The column electrodes D and the row electrodes X and Y are formed on two glass substrates, arranged in opposition and enclosing a discharge space into which is injected a discharge gas. Discharge cells, serving as display elements corresponding to individual pixels, are formed at the portions of intersection of each of the row electrode pairs with the column electrodes.

When the synchronization detection circuit 1 detects a vertical sync signal in the input image signal, it generates a vertical synchronization detection signal V and supplies this signal to the driving control circuit 2 and the vertical sync frequency detection circuit 3. Also, when the synchronization detection circuit 1 detects a horizontal sync signal in the above input image signal, it generates a horizontal synchronization detection signal H and supplies this signal to the driving control circuit 2. The vertical sync frequency detection circuit 3 measures the period of the above vertical synchronization detection signal V, and by this means determines the vertical sync frequency in the above input image signal, and supplies to the driving control circuit 2 and data conversion circuit 30 a vertical sync frequency signal VG which indicates this frequency value. The A/D converter 4 samples the above input image signal, according to a clock signal provided by the driving control circuit 2, and converts this into pixel data D with, for example, 8 bits per pixel; this is supplied to the data conversion circuit 30 and the mean brightness detection circuit 40.

The mean brightness detection circuit 40 determines the mean brightness level of the input image signal based on the above pixel data D, supplied in order by the A/D converter 4, and supplies a mean brightness signal AB indicating this mean brightness level to the driving control circuit 2.

The data conversion circuit 30 executes multi-grayscale processing on the above pixel data D, and within one field interval, converts the results into pixel driving data GD to drive the emission of individual discharge cells.

Figure 5:
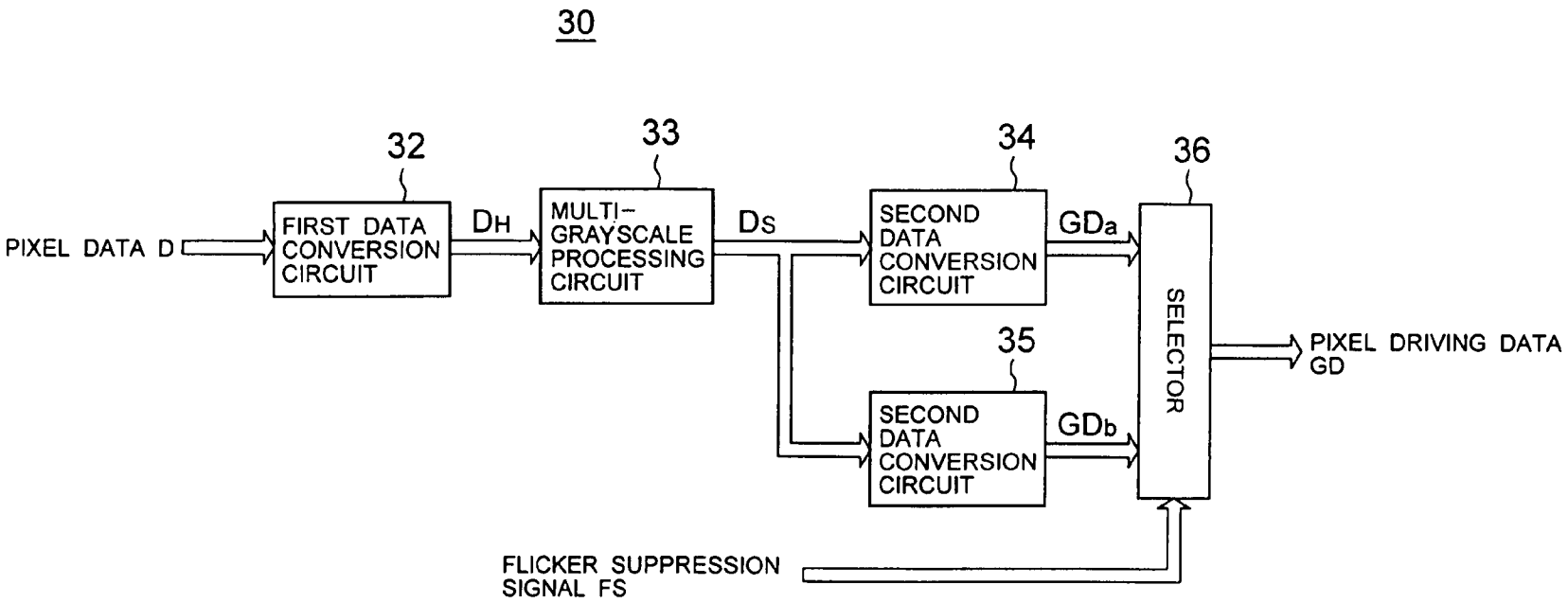
FIG. 5 is a figure showing the internal configuration of the data conversion circuit 30.

FIG. 5 is a figure showing the internal configuration of the data conversion circuit 30.

Figure 6:
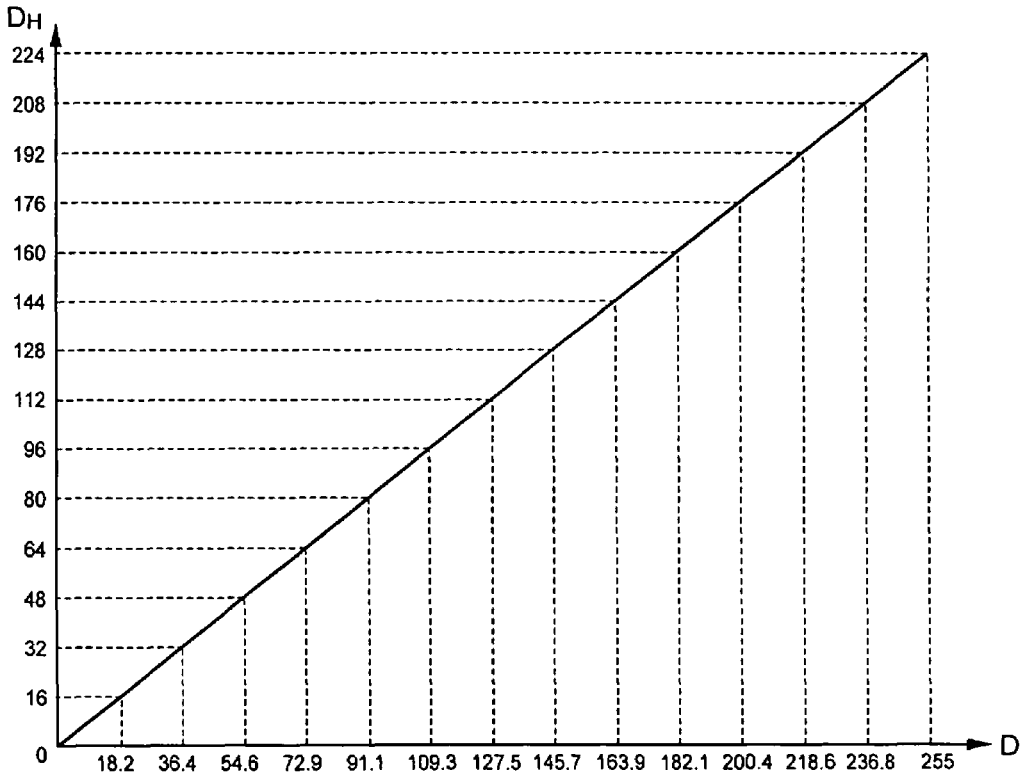
FIG. 6 is a figure showing the data conversion characteristic in the first data conversion circuit 32.

In FIG. 5, the first data conversion circuit 32 provides the results of conversion of the above pixel data D into (14×16)/255, based on conversion characteristics as shown in FIG. 6, to the multi-grayscale processing circuit 33 as converted pixel data $D_H$. That is, the first data conversion circuit 32 converts pixel data D, capable of representing the brightnesses of 256 grayscales from 0 to 255 in 8 bits, into converted pixel data $D_H$ capable of representing the brightnesses of 225 grayscales from 0 to 224 in 8 bits. Specifically, the first data conversion circuit 32 converts the above pixel data D into converted pixel data $D_H$, based on the conversion tables in FIG. 7 and FIG. 8, which conform to the conversion characteristic shown in FIG. 6. The conversion characteristic is set according to the number of bits of the pixel data, the number of compressed bits resulting from conversion to multiple grayscales, described below, and the number of display grayscales. In this way, before executing the multi-grayscale processing described below, conversion is performed by the first data conversion circuit 32, taking into account the number of display grayscales and the number of compressed bits resulting from multi-grayscale processing. As a result of this data conversion, the occurrence of brightness saturation in the multi-grayscale processing described below, and the occurrence of flat portions in the display characteristic (that is, the occurrence of grayscale distortion) arising when there are no display grayscales at bit boundaries, are prevented.

Figure 9:
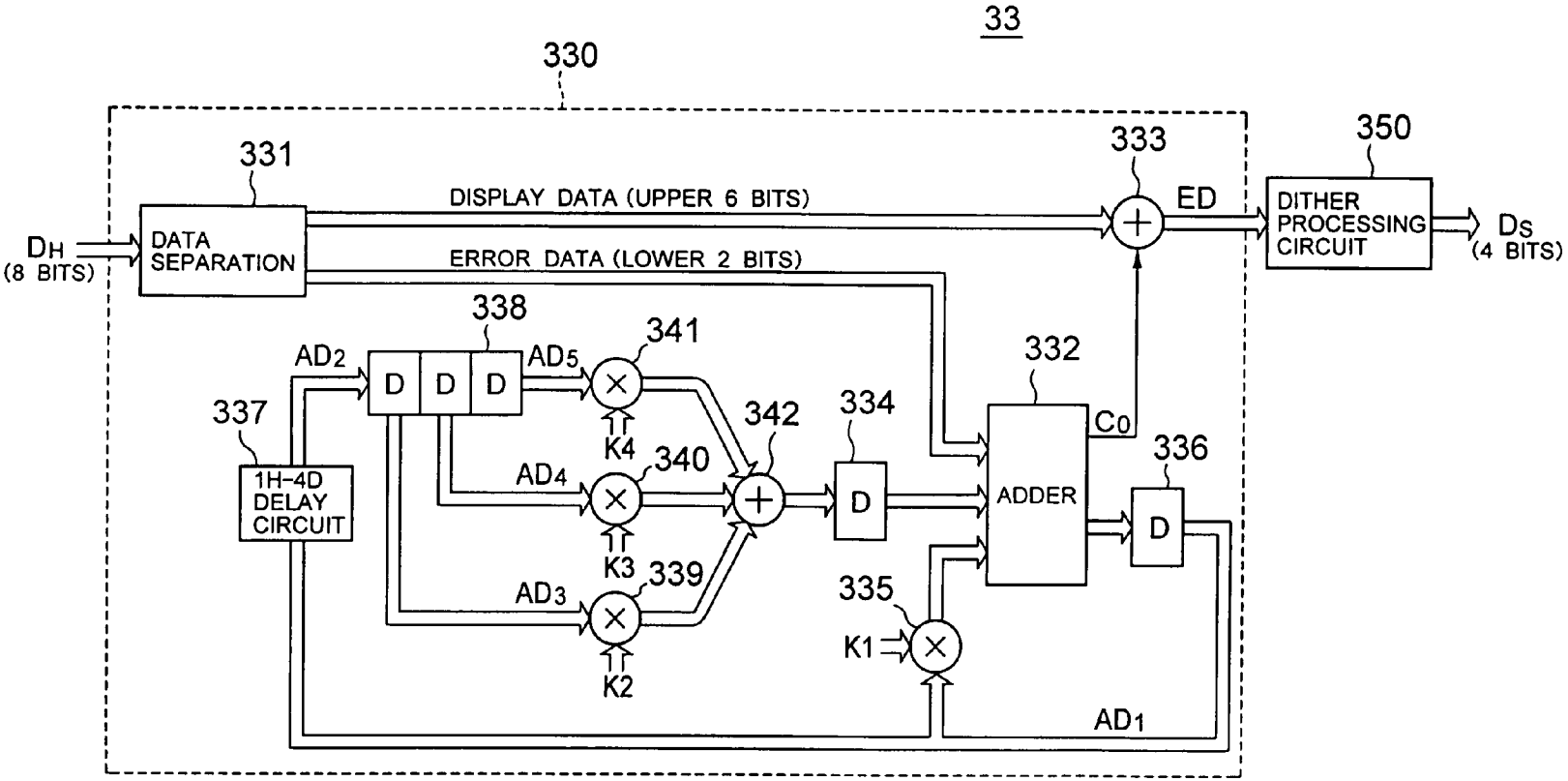
FIG. 9 is a figure showing the internal configuration of the multi-graycale processing circuit 33.

FIG. 9 is a figure showing the internal configuration of the multi-graycale processing circuit 33, which executes multi-grayscale processing.

As shown in FIG. 9, the multi-grayscale processing circuit 33 comprises an error diffusion processing circuit 330 and dither processing circuit 350.

The data separation circuit 331 in the error diffusion processing circuit 330 separates the lower 2 bits of the 8 bits of converted pixel data $D_H$ provided by the above first data conversion circuit 32 as error data, and the upper 6 bits as display data. The adder 332 adds this error data, delay output from the delay circuit 334, and multiplication output from the coefficient multiplier 335, and provides the result of addition to the delay circuit 336. The delay circuit 336 supplies the addition result from the adder 332, delayed by the time duration of one clock period of pixel data (hereafter called delay time D), to the above coefficient multiplier 335 and delay circuit 337 as the delayed addition signal $AD_1$. The coefficient multiplier 335 supplies to the above adder 332 the result of multiplying the above delayed addition signal $AD_1$ by a prescribed coefficient $K_1$ (for example "7/16"). The delay circuit 337 supplies to the delay circuit 338 the above delayed addition signal $AD_1$, further delayed by an amount of time (1 horizontal scan interval−above delay time D×4), as the delayed addition signal $AD_2$. The delay circuit 338 supplies to the coefficient multiplier 339 this delayed addition signal $AD_2$, further delayed by the above delay time D, as the delayed addition signal $AD_3$. The delay circuit 338 also supplies to the coefficient multiplier 340 the above delayed addition signal $AD_2$, delayed by an amount of time (delay time D×2), as the delayed addition signal $AD_4$. Besides, the delay circuit 338 supplies to the coefficient multiplier 341 the above delayed addition signal $AD_2$, delayed by an amount of time (delay time D×3), as the delayed addition signal $AD_5$. The coefficient multiplier 339 supplies to the adder 342 the result of multi plying the above delayed addition signal $AD_3$ by a prescribed coefficient $K_2$ (for example, "3/16"). The coefficient multiplier 340 supplies to the adder 342 the result of multiplying the above delayed addition signal $AD_4$ by a prescribed coefficient $K_3$ (for example, "5/16"). The coefficient multiplier 341 supplies to the adder 342 the result of multiplying the above delayed addition signal $AD_5$ by a prescribed coefficient $K_4$ (for example, "1/16"). The adder 342 supplies to the above delay circuit 334 the addition signal obtained by adding the multiplication results supplied by the above coefficient multipliers 339, 340 and 341. The delay circuit 334 supplies the addition signal, delayed by an amount of time equal to the above delay time D, to the above adder 332. The adder 332 supplies to the adder 333 the above error data, the delayed output from the delay circuit 334, and a carry-out signal $C_o$ which is at logical level "0" if there is no carry digit when adding with the multiplication output of the coefficient multiplier 335, and is at logical level "1" if there is a carry digit. The adder 333 outputs the result of addition of the above carryout signal $C_o$ to the display data which is the upper 6 bits of the above converted pixel data $D_H$ as 6 bits of error diffusion processed pixel data ED.

Below, operation of an error diffusion processing circuit 330 with the configuration described is explained.

Figure 10:
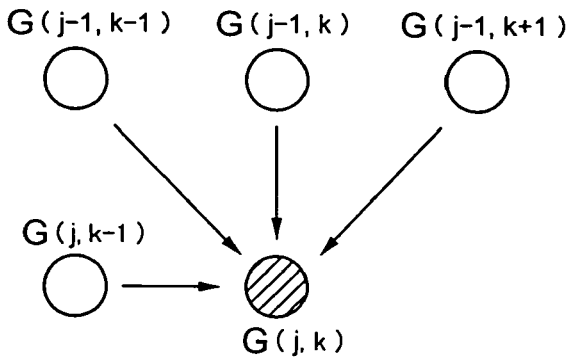
FIG. 10 is a figure used to explain the operation of the error diffusion processing circuit 330.

For example, when determining the error diffusion processed pixel data ED corresponding to the pixel G(j,k) of the PDP 10, as shown in FIG. 10, first, prescribed coefficients $K_1$ to $K_4$ as described above are used to weight by addition the error data corresponding to the pixel G(j,k−1) on the left of the pixel G(j,k) in question; the pixel G(j−1,k−1) on the upper left; the pixel G(j−1,k) directly above; and the pixel G(j−1,k+1) on the upper right, as follows:

Error data corresponding to pixel G(j,k−1): Delayed addition signal $AD_1$

Error data corresponding to pixel G(j−1,k+1): Delayed addition signal $AD_3$

Error data corresponding to pixel G(j−1,k): Delayed addition signal $AD_4$

Error data corresponding to pixel G(j−1,k−1): Delayed addition signal $AD_5$

Next, to these addition results are added the lower 2 bits of the converted pixel data $HD_P$, that is, the error data corresponding to the pixel G(j,k); the 1-bit carry-out signal $C_o$ obtained in this operation added to the upper 6 bits of converted pixel data $D_H$ that is, the display data corresponding to the pixel G(j,k), is then taken to be the error diffusion processed pixel data ED.

By means of this configuration, in the error diffusion processing circuit 330, the upper 6 bits of the converted pixel data $D_H$ is taken to be the display data and the remaining lower 2 bits to be the error data, and the weighted error data for each of the peripheral pixels {G(j,k−1), G(j−1,k+1), G(j−1,k), G(j−1,k−1)} is reflected in the above display data. Through this operation, the brightness of the lower 2 bits at the origin pixel {G(j,k)} is approximately represented by the above peripheral pixels, and consequently, 6 bits' worth of display data, fewer than 8 bits' worth, can be used to represent brightness grayscales equivalent to 8 bits' worth of pixel data.

If the coefficients of this error diffusion are added uniformly for each pixel, in some cases noise due to error diffusion patterns may be perceived visually, so that image quality will be degraded. Hence the error diffusion coefficients $K_1$ to $K_4$ to be allocated to each of the four peripheral pixels may be changed for each field.

The dither processing circuit 350 performs dither processing of error diffusion processed pixel data ED supplied by the error diffusion processing circuit 330. In this dither processing, one intermediate display level is represented by a plurality of neighboring pixels. For example, when the upper 6 bits of pixel data among 8 bits of pixel data are used for grayscale representation equivalent to 8 bits, the four pixels adjacent on the left and right, and above and below, are taken to be one set, and four dither coefficients a to d, which are different coefficient values, are allocated and added to each of the pixel data values corresponding to each of the pixels of this set. Through this dither processing, four pixels can produce combinations of four different intermediate display levels. Hence even if there are only 6 bits of pixel data, the number of levels of brightness grayscales which can be represented is increased fourfold, that is, intermediate grayscales equivalent to 8 bits can be displayed.

However, if a dither pattern with dither coefficients a through d is added uniformly to each pixel, there are cases in which noise due to this dither pattern is perceived visually, and the image quality is degraded.

Hence in the dither processing circuit 350, the dither coefficients a to d to be allocated to each of the four pixels are changed for each field.

Figure 11:
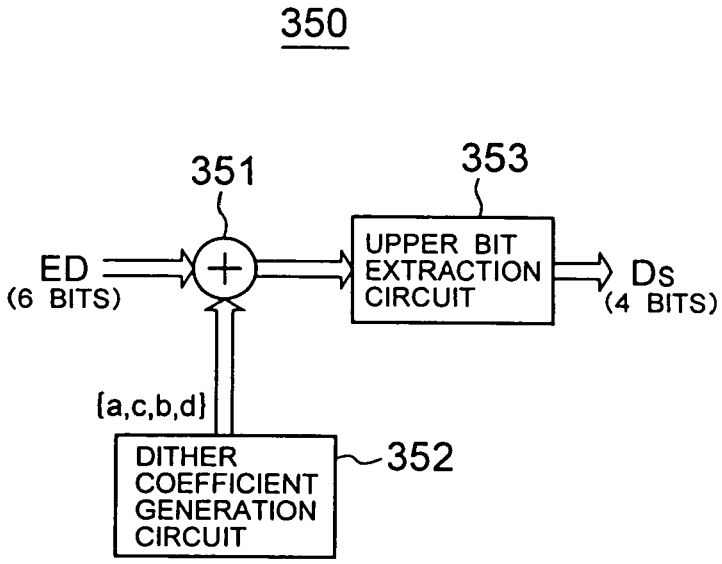
FIG. 11 is a figure showing the internal configuration of the dither Processing circuit 350.

FIG. 11 is a figure showing the internal configuration of the dither processing circuit 350.

Figure 12:
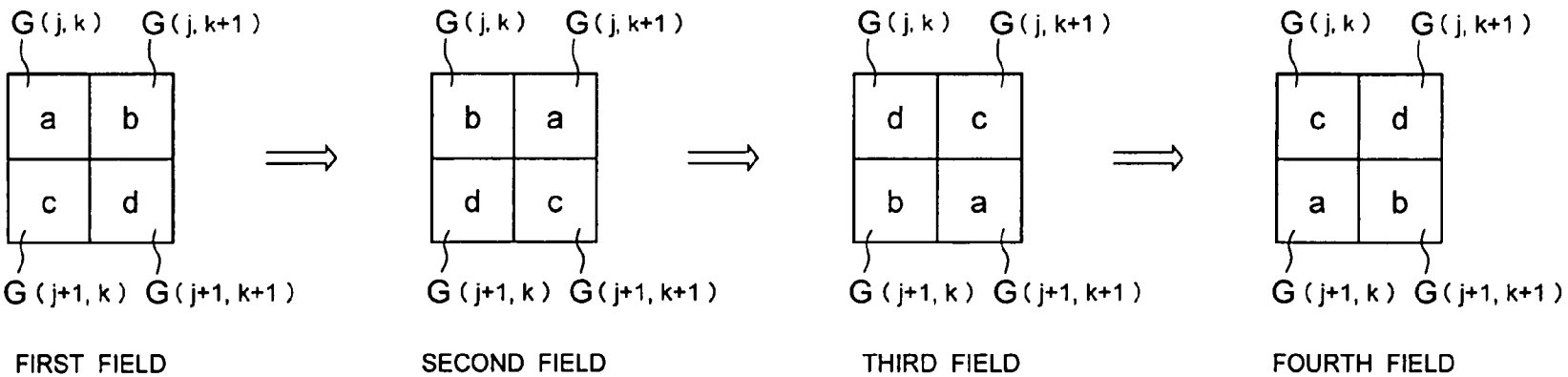
FIG. 12 is a figure used to explain the operation of the dither processing circuit 350.

In FIG. 11, the dither coefficient generation circuit 352 generates four dither coefficients a, b, c, d for each of four adjacent pixels [G(j,k), G(j,k+1), G(j+1,k), G(j+1,k+1)] as shown in FIG. 12, and supplies these in order to the adder 351. Further, the dither coefficient generation circuit 352 changes, for each field, the allocation of the dither coefficients a through d generated corresponding to each of the four pixels, as shown in FIG. 12.

In other words, dither coefficients a through d are generated in cyclic repetition and supplied to the adder 351, with the following allocations.

In the first field,
pixel G(j,k): dither coefficient a
pixel G(j,k+1): dither coefficient b
pixel G(j+1,k): dither coefficient c
pixel G(j+1,k+1): dither coefficient d
In the second field,
pixel G(j,k): dither coefficient b
pixel G(j,k+1): dither coefficient a
pixel G(j+1,k): dither coefficient d
pixel G(j+1,k+1): dither coefficient c
In the third field,
pixel G(j,k): dither coefficient d
pixel G(j,k+1): dither coefficient c
pixel G(j+1,k): dither coefficient b
pixel G(j+b 1,k+1): dither coefficient a
And in the fourth field,
pixel G(j,k): dither coefficient c
pixel G(j,k+1): dither coefficient d
pixel G(j+1,k): dither coefficient a
pixel G(j+1,k+1): dither coefficient b The dither coefficient generation circuit 352 repeatedly executes the operation for the first through fourth fields as described above. That is, after completing the operation to generate dither coefficients in the fourth field, the circuit returns to the operation for the above first field, and repeats the operation described above.

The adder 351 adds the dither coefficients a through d allocated for each field as described above to the error diffusion processed pixel data ED corresponding to the above pixel G(j,k), pixel G(j,k+1), pixel G(j+1,k), and pixel G(j+1,k+1), su plied from the above error diffusion processing circuit 330. The dither added pixel data obtained is supplied to the upper bit extraction circuit 353.

For example, in the first field shown in FIG. 12, the following are supplied in order as dither added pixel data to the upper bit extraction circuit 353:

Error diffusion processed pixel data ED corresponding to the pixel G(j,k)+dither coefficient a, Error diffusion processed pixel data ED corresponding to the pixel G( j,k+1)+dither coefficient b, Error diffusion processed pixel data ED corresponding to the pixel G(j+1,k)+dither coefficient c, and Error diffusion processed pixel data ED corresponding to the pixel G(j+1, k+1)+dither coefficient d.

In this process, when a plurality of pixels are viewed as a single pixel unit, as shown in FIG. 10, through addition of the above dither coefficients, brightness equivalent to 8 bits can be rep resented even with only the upper 4 bits of the above dither added pixel data. Hence the upper bit extraction circuit 353 of the next stage extracts the upper 4 bits of the dither added pixel data, and these are supplied to the second data conversion circuits 34 and 35 shown in FIG. 5 as multi-grayscale pixel data $D_S$.

The second data conversion circuit 34 converts the multi-grayscale pixel data $D_S$ into 14-bit pixel driving data $GD_a$ according to the data conversion table shown in FIG. 13, and supplies this to the selector 36.

On the other hand, the second data conversion circuit 35 converts the above multi-grayscale pixel data $D_S$ into 14-bit pixel driving data $GD_b$ according to the data conversion table shown in FIG. 14, and supplies the result to the selector 36. When a flicker suppression signal FS at logical level "0" is supplied from the driving control circuit 2, the selector 36 selects GD*a* from among the above pixel driving data GD*a* and $GD_b$ for use as pixel driving data GD, and supplies this to the memory 5 shown in FIG. 4. On the other hand, when a flicker suppression signal FS with logical level "1" is supplied, the selector 36 selects the above pixel driving data $GD_b$, and supplies this to the memory 5 as pixel driving data GD.

The memory 5 writes in order this pixel driving data GD, according to write signals supplied from the driving control circuit 2. When, by means of this write operation, one screen's worth (n rows, m columns) of writing is completed, the memory 5 reads out the written data according to read signals supplied from the driving control circuit 2. That is, in the memory 5, one screen's worth of the written pixel driving data $GD_{11}$ to $GD_{nm}$ is taken to be pixel driving data bit groups DB1 to DB14, grouped by the bit digit (from the first to the 14th bit).

The pixel driving data bit groups DB1 to DB14 are as follows.

DB1: 1st bit of each of $GD_{11}$ to $GD_{nm}$
DB2: 2nd bit of each of $GD_{11}$ to $GD_{nm}$
DB3: 3rd bit of each of $GD_{11}$ to $GD_{nm}$
DB4: 4th bit of each of $GD_{11}$ to $GD_{nm}$
DB5: 5th it of each of $GD_{11}$ to $GD_{nm}$ DB6: 6th bit of each of $GD_{11}$ to $GD_{nm}$
DB7: 7th bit of each of $GD_{11}$ to $GD_{nm}$
DB8: 8th bit of each of $GD_{11}$ to $GD_{nm}$
DB9: 9th bit of each of $GD_{11}$ to $GD_{nm}$
DB10: 10th bit of each of $GD_{11}$ to $GD_{nm}$
DB11: 11th bit of each of $GD_{11}$ to $GD_{nm}$
DB12: 12th bit of each of $GD_{11}$ to $GD_{nm}$
DB13: 13th bit of each of $GD_{11}$ to $GD_{nm}$
DB14: 14th bit of each of $GD_{11}$ to $GD_{nm}$ The memory 5 reads out in order, one display line at a time, each of these pixel driving data bit groups DB1 to DB14, corresponding to each of the subfields SF1 to SF14 described below.

The driving control circuit 2 executes emission driving control as follows, according to the above vertical sync frequency signal VF and mean brightness signal AB.

When the vertical sync frequency indicated by the above vertical sync frequency signal VF is equal to or greater than, for example, 60 Hz, or when the mean brightness level indicated by the mean brightness signal AB is lower than a prescribed level, the driving control circuit 2 first supplies a logical level "0" flicker suppression signal FS to the data conversion circuit 30. In this process, the selector 36 of the data conversion circuit 30 supplies pixel driving data GD*a*, converted by the second data conversion circuit 34, to memory 5 in response to this logical level "0". flicker suppression signal FS. The driving control circuit 2 then supplies, to the address driver 6, first sustaining driver 7 and second sustaining driver 8, various timing signals so as to cause emission driving of the PDP 10 according to the emission driving format shown in FIG. 15.

Figure 15:
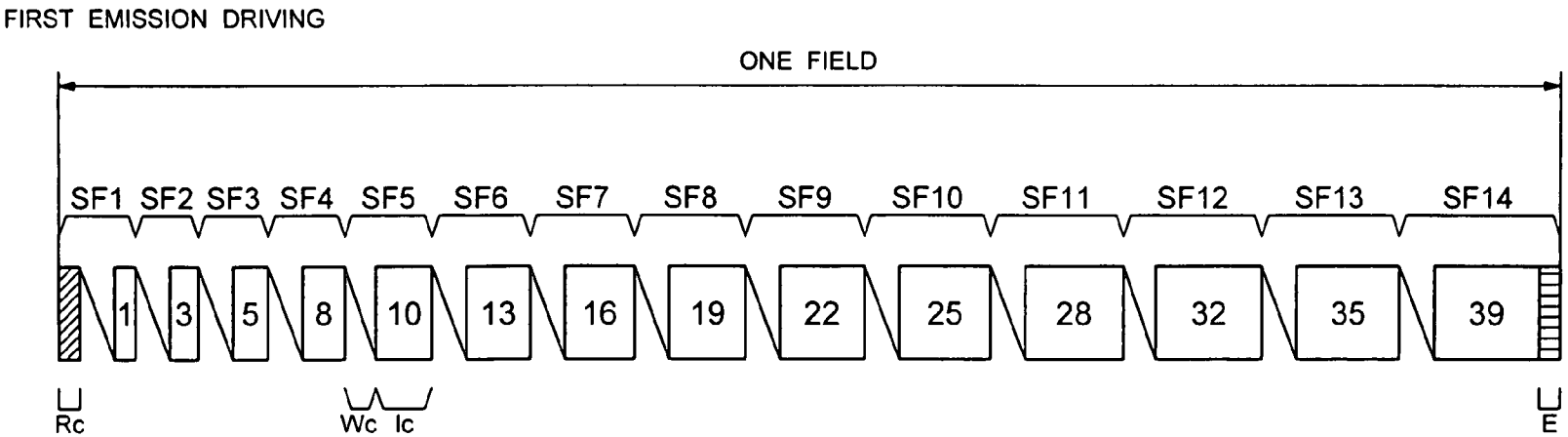
FIG. 15 is a figure showing one example of an emission driving format (based on the selective erasing address method) during first emission driving, adopted when the vertical sync frequency of the input image signal is equal to or higher than a prescribed frequency, or when the brightness level of the input image signal is comparatively low.

That is, w hen the brightness level of the input image signal is low, or when for example an NTSC format television signal or other signal with vertical sync frequency at 60 Hz or higher is supplied as the input image signal, emission driving is executed as shown in FIG. 13 and FIG. 15.

On the other hand, when the vertical sync frequency indicated by the above vertical sync frequency signal VF is less than 60 Hz, and in addition the mean brightness level indicated by the mean brightness signal AB is higher than a prescribed level, the driving control circuit 2 first supplies a logical level "1" flicker suppression signal FS to the data conversion circuit 30. In this process, the selector 36 of the data conversion circuit 30 supplies to the memory 5 pixel driving data $GD_b$ converted by the second data conversion circuit 35 in response to this logical level "1" flicker suppression signal FS. The driving control circuit 2 then supplies, to the address driver 6, first sustaining driver 7 and second sustaining driver 8, various timing signals so as to cause emission driving of the PDP 10, according to the emission driving format shown in FIG. 16.

Figure 16:
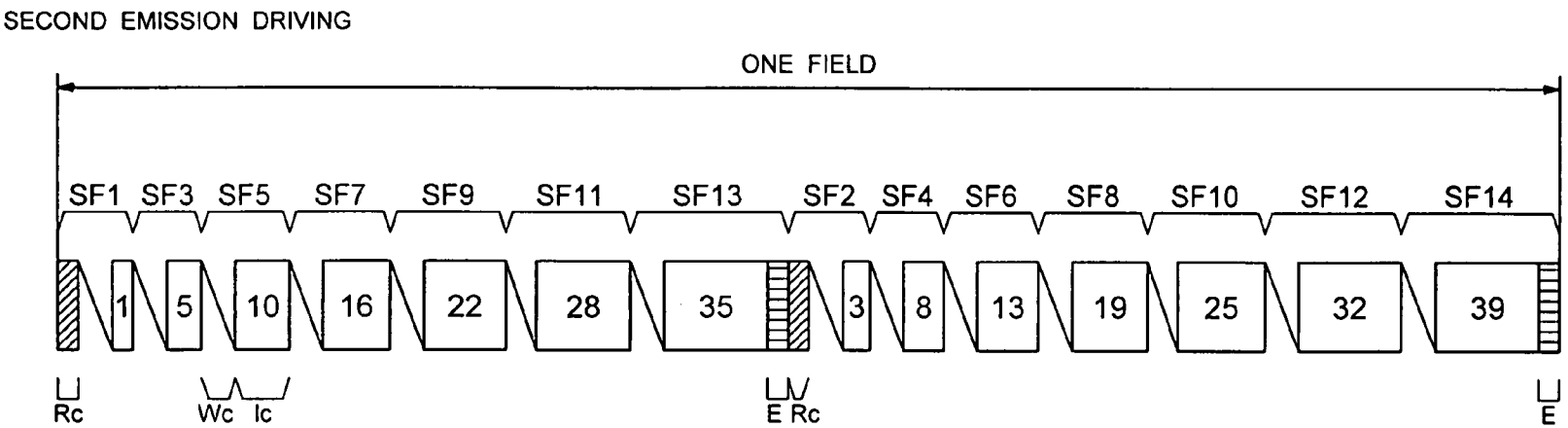
FIG. 16 is a figure showing on example of an emission driving format (based on the selective erasing address method) during second emission driving, adopted when the vertical sync frequency of the input image signal is lower than a prescribed frequency, and the brightness level of the input image signal is comparatively high.

In other words, if as the input image signal a PAL format television signal or other signal with a vertical sync frequency less than 60 Hz is supplied, and in addition the mean brightness is high, then emission driving is executed as shown in FIG. 14 and FIG. 16.

In the emission driving format shown in FIG. 15 and FIG. 16, the display interval of one field (hereafter this expression also refers to one frame) is divided into 14 subfields SF1 to SF14. Within each subfield, executed are an address sequence Wc, in which each of the discharge cells of the PDP 10 is set to either the "lit discharge cell state" or the "extinguish discharge cell state", and an emission sustain sequence Ic which causes only discharge cells in the above "lit discharge cell state" to emit repeatedly the number of times indicated in FIG. 15 (or in FIG. 16). Also, in the leading subfield SF1, a simultaneous reset sequence Rc is executed which initializes the wall charge within all the discharge cells of the PDP 10; and in the final subfield SF14, an erasing sequence E is executed which simultaneously eliminates the wall charge within all the discharge cells.

In the emission driving format shown in FIG. 16, the emission driving in the subfields SF1, SF3, SF5, SF7, SF9, SF11, SF13 in the emission driving format of FIG. 15 is executed in the first half of the one-field display interval, and the emission driving in the subfields SF2, SF4, SF6, SF8, SF10, SF12, SF14 is executed in the second half. Here, the above erasing sequence E is executed in the final subfield SF13 of the first half, and the above simultaneous reset sequence Rc is executed in the leading subfield SF2 of the second half.

The address driver 6, first sustaining driver 7 and second sustaining driver 8 apply various driving pulses in order to realize the operations of each of the above sequences to the electrodes of the PDP 10, with timing determined by the timing signals supplied by the driving control circuit 2.

Figure 17:
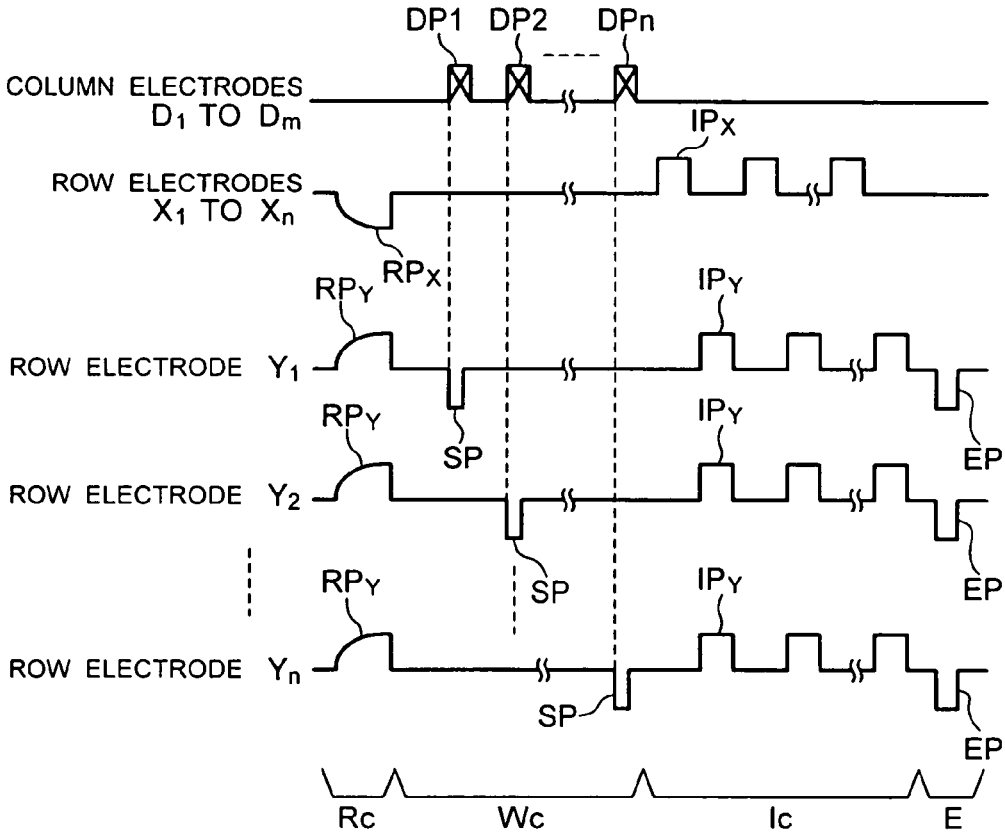
FIG. 17 is a figure showing the various driving pulses applied to the PDP 10, and the application timing.

FIG. 17 shows the timing of the application of various driving pulses applied to the column electrodes D and the row electrodes X and Y of the PDP 10 by the above drivers, during the above simultaneous reset sequence Rc, address sequence Wc, emission sustain sequence Ic, and erasing sequence E.

First, in the above simultaneous reset sequence Rc, the first sustaining driver 7 and second sustaining driver 8 each simultaneously apply reset pulses $RP_X$ and $RP_Y$ to the row electrodes $X_1$ to $X_n$ and $Y_1$ to $Y_n$, as shown in FIG. 17. In response to the application of these reset pulses $RP_X$ and $RP_Y$, all the discharge cells in the PDP 10 undergo reset discharge, and a prescribed uniform wall charge is formed within each of the discharge cells. By this means, all the discharge cells are set to the initial "lit discharge cell state".

Next, in the address sequence Wc, the address driver 6 generates pixel data pulses having voltages corresponding to the logical levels of each pixel driving data bit in the pixel driving data bit group DB read from the above memory 5. For example, the address driver 6 generates a high-voltage pixel data pulse when the logical level of the pixel driving data bit is "1", and generates a low-voltage (0 volt) pixel data pulse when it is "0". The address driver 6 applies these pixel data pulses, one display line (m pulses) at a time, to the column electrodes $D_1$ to $D_m$. For example, in the address sequence Wc of the subfield SF1, the pixel driving data bit group DB1 is read from memory 5, as described above. In this process, the address driver 6 first converts m pixel driving data bits corresponding to the first display line in the pixel driving data bit group DB1 into m pixel data pulses having pulse voltages corresponding to the respective logical levels, and applies these to the column electrodes $D_1$ to $D_m$ as the pixel data pulses group DP1. Next, the address driver 6 converts the m pixel driving data bits corresponding to the second display line in the pixel driving data bit group DB1 into m pixel data pulses having pulse voltages which correspond to the respective logical levels, and apply these to the column electrodes $D_1$ to $D_m$ as the pixel data pulse group DP2. Subsequently, similar operations are performed in the address sequence Wc of the subfield SF1 to apply pixel data pulse groups DP3 to DPn, corresponding to the 3rd through nth display lines of the pixel data pulse group DP1, in order to the column electrodes $D_1$ to $D_m$, In the address sequence Wc of the subfield SF2, the pixel driving data bit group DB2 is read from memory 5, as described above. Here, the address driver 6 converts the m pixel driving data bits corresponding to the first display line in the pixel driving data bt group DB2 into m pixel data pulses having pulse voltages corresponding to the respective logical levels, and applies these to the column electrodes $D_1$ to $D_m$ as the pixel data pulse group DP1. Then the address driver 6 converts the m pixel driving data bits corresponding to the second display line in the pixel driving data bit group DB2 into m pixel data pulses having pulse voltages which correspond to the respective logical levels, and applies these to the column electrodes $D_1$ to $D_m$ as the pixel data pulse group DP2. Subsequently, similar operations are performed in the address sequence Wc of the subfield SF2 to apply pixel data pulse groups DP3 to DPn, corresponding to the 3rd through nth display lines of the pixel data pulse group DP2, in order to the column electrodes $D_1$ to $D_m$.

Further, in each address sequence Wc the second sustaining driver 8 generates negative-polarity scan pulses SP as shown in FIG. 17, with the same timing as the timing of application of the above-described pixel data pulse groups DP, and applies these in order to the row electrodes $Y_1$ to $Y_n$. In this process, discharge (selective erasing discharge) occurs only in discharge cells at the intersections of row electrodes Y to which a scan pulse SP is applied, and column electrodes D to which a high-voltage pixel data pulse is applied; the wall charge which had remained within the discharge cells is then selectively eliminated. Discharge cells which have been initialized by this selective erasing discharge to the "lit discharge cell state" in the above simultaneous reset sequence Rc are set to the "extinguished discharge cell state". On the other hand, discharge is not induced in discharge cells belonging to column electrodes D to which a low-voltage pixel data pulse is applied, and the current state is maintained. That is, discharge cells in the "extinguished discharge cell state" remain in the "extinguished discharge cell state", and discharge cells in the "lit discharge cell state" are maintained in the "lit discharge cell state".

Next, in the emission sustain sequence Ic for each subfield, positive-polarity sustain pulses $IP_X$ and $IP_Y$ are applied repeatedly in alternation to the row electrodes $X_1$ to $X_n$ and $Y_1$ to $Y_n$ by the first sustaining driver 7 and second sustaining driver 8, as shown in FIG. 17. As shown in FIGS. 15 and 16, in the emission sustain sequence Ic for each of the subfields SF1 to SF14, the number of times that the above sustain pulse IP is applied repeatedly is, if the number of times in SF1 is "1":

SF1: 1
SF2: 3
SF3: 5
SF4: 8
SF5: 10
SF6: 13
SF7: 16
SF8: 19
SF9: 22
SF10: 25
SF11: 28
SF12: 32
SF13: 35
SF14: 39

Here, only discharge cells in which wall charge is formed, that is, only discharge cells in the "lit discharge cell state", undergo discharge each time these sustain pulses $IP_X$ and $IP_Y$ are applied (sustaining discharge), and sustain the emission state accompanying this discharge. The longer the time over which the emission state is sustained, the brighter the emitted light as perceived by the human eye.

In the era sing sequence E, the second sustaining driver 8 generates negative-polarity erasing pulses EP and applies them to the row electrodes $Y_1$ through $Y_n$, as shown in FIG. 17. Through application of these erasing pulses EP, an erasing discharge is induced within all the discharge cells of the PDP 10, and the wall charge remaining within all the discharge cells is annihilated. That is, by means of this erasing discharge, all the discharge cells in the PDP 10 are forcibly set to the "extinguished discharge cell state".

Through the driving described above, only those discharge cells set in the "lit discharge cell state" during the address sequence Wc within each subfield undergo emission a number of times corresponding to subfield weighting for each subfield, as described above.

In this process, whether each discharge cell is set to the "lit discharge cell state" or to the "extinguished discharge cell state" is determined by the pixel driving data GD*a* or GD*b* shown in FIG. 13 or FIG. 14. That is, if a bit in the pixel driving data GD is at logical level "1", selective erasing discharge is induced in the address sequence Wc of the subfield corresponding to the bit digit, and the discharge cell is put into the "extinguished discharge cell state". On the other hand, if a bit in the pixel driving data GD is at logical level "0", then the above selective erasing discharge is not induced in the address sequence Wc of the subfield corresponding to the bit digit. Hence discharge cells in the "extinguished discharge cell state" remain in the "extinguished discharge cell state", and discharge cells in the "lit discharge cell state" are maintained in the "lit discharge cell state".

In the pixel driving data GD*a* shown in FIG. 13, each of the first through 14th bits determines whether or not selective erasing discharge is induced in the address sequence Wc for the respective subfields SF1 to SF14 in FIG. 15. Hence when the pixel driving data GD*a* shown in FIG. 13 is used to perform driving according to the emission driving format of FIG. 15, first all the discharge cells are initialized to the "lit discharge cell state" in subfield SF1. The "lit discharge cell state" of discharge cells is maintained until a selective erasing discharge is induced by the address sequence Wc in the subfields indicated by black circles in FIG. 13. Hence in the emission sustain sequences Ic in each of the subfields (indicated by white circles) existing while the above "lit discharge cell state" is maintained, sustaining discharge emission is executed a number of times corresponding to the weighting for that subfield. As a result, an intermediate brightness is perceived according to the total number of sustaining discharge emissions induced in the emission sustain sequence Ic for each subfield during the interval for one field.

Consequently if the pixel driving data GD*a* having the 15 patterns shown in FIG. 13 is used to perform driving according to the emission driving format shown in FIG. 15, then intermediate-level brightnesses in 15 stages can be expressed, as follows:

{0:1:4:9:17:27:40:56:75:97:122:150:182:217:255}

By means of grayscale driving in these 15 stages, and multi-grayscale processing by the multi-grayscale processing circuit 33 as described above, intermediate brightnesses which are visually equivalent to 256 grayscales can be expressed.

On the other hand, in the pixel driving data GD*b* shown in FIG. 14, the first through 14th bits correspond to the subfields SF1 to SF14 in FIG. 16 as follows.

$GD_b$ 1st bit: SF1
$GD_b$ 2nd bit: SF3
$GD_b$ 3rd bit: SF5
$GD_b$ 4th bit: SF7

$GD_b$ 5th bit: SF9
$GD_b$ 6th bit: SF11
$GD_b$ 7th bit: SF13
$GD_b$ 8th bit: SF2
$GD_b$ 9th bit: SF4
$GD_b$ 10th bit: SF6
$GD_b$ 11th bit: SF8
$GD_b$ 12th bit: SF10
$GD_b$ 13th bit: SF12
$GD_b$ 14th bit: SF14

Further, in the emission driving format shown in FIG. 16, the simultaneous reset sequence Rc is executed in subfield SF2 as well as in subfield SF1.

Hence if driving is performed using the pixel driving data GD shown i FIG. 14 according to the emission driving format of FIG. 16, all discharge cells are initialized to the "lit discharge cell state" in the subfields SF1 and SF2. This "lit discharge cell state" is maintained until selective erasing discharge is induced in the address sequence Wc for subfields, indicated by the black circles in FIG. 14. In this process, sustaining discharge emission is executed repeatedly a number of times corresponding to the weighting for the subfield during the emission sustain sequences Ic for subfields (indicated by white circles) while the above "lit discharge cell state" is maintained. When selective erasing discharge is induced in the address sequence Wc for a subfield indicated by a black circle in FIG. 14, each of the discharge cell makes a transition to the "extinguished discharge cell state". In this process, an intermediate brightness is perceived corresponding to the total number of sustaining discharge emissions induced in the emission sustain sequence Ic for each subfield within one field interval.

Hence if, as shown in FIG. 14, the 15 patterns of pixel driving data $GD_b$ are used to perform driving according to the emission driving format shown in FIG. 16, similarly to the driving shown in FIGS. 13 and 15 and described above, it is possible to express intermediate-level brightnesses in 15 stages:

{0:1:4:9:17:27:40:56:75:97:122:150:182:217:255}

In the driving shown in FIGS. 13 and 15 (hereafter called the first emission driving), reset discharge is induced to form wall charge within all discharge cells only in the leading subfield of one field. Then, selective erasing discharge is induced one time at most within the display interval for one field, to selectively eliminate the wall charge formed within each discharge cell. By this means, the number of times there is a switch from the continuous emission state, in which subfields in which sustaining discharge emission is performed are continuous (shown by white circles in FIG. 13), to the continuous extinguished state, in which subfields in the extinguished state are continuous, is at most one time. Hence as shown in FIG. 13, there are no emission driving patterns among the 15 emission driving patterns in which intervals of the continuous emission state and intervals of the continuous extinguished state are inverted within one field display interval. Consequently within one screen, when there are two adjacent screen regions in which the continuous emission state interval and the continuous extinguished state interval are inverted, the occurrence of the false contours which are thought to occur at such boundaries is suppressed. Also, in the above first emission driving, reset discharge, which requires a comparatively large amount of power, is executed only once at the beginning of a field, so that power consumption is suppressed.

On the other hand, in driving as shown in FIGS. 14 and 16 (hereafter called the second emission driving), grayscale driving is adopted in which the display interval for one field is divided into first-half driving intervals (SF1, SF3, SF5, SF7, SF9, SF11, SF13) and second-half driving intervals (SF2, SF4, SF6, SF8, SF10, SF12, SF14). As indicated by the white circles in FIG. 14, in the driving intervals of the first half, emission is executed continuously from the beginning over a time period corresponding to the brightness level of the input image signal. In driving intervals of the second half, emission is executed continuously from the beginning over a time period corresponding to the brightness level of the input image signal. Thus as shown in FIG. 14, among the 15 emission driving patterns, there exist no emission driving patterns in which the interval of the continuous emission state and the interval of the continued extinguished state are inverted within one field display interval. Consequently within one screen, when two screen regions in which the continuous emission state interval and the continuous extinguished state interval are mutually inverted, the false contours which are said to occur at the boundary are suppressed. Also, by means of the above second emission driving, switching from the continuous emission state wherein subfields in which sustaining discharge emission is induced are continuous, to the continuous extinguished state wherein subfields in the extinguished state are continuous, occurs at most two times within one field interval. That is, the time between the moment of initiation of emission in the above first-half driving interval, and the moment of initiation of emission in the second-half driving interval, is approximately ½ the display interval for one field, and the frequency of switching between the above continuous emission state and the above continuous extinguished state is approximately 2 times the vertical sync frequency which determines the display interval for one field. As a result, even if a PAL format television signal with a vertical sync frequency of 50 Hz is supplied as the input image signal, and the mean brightness expressed by the PAL format television signal is comparatively high, a good-quality image without flicker is displayed.

As explained above, in this invention, when an image signal with a low mean brightness level is input, or when an image signal with a high vertical sync frequency is input, the first emission driving (FIG. 13 and FIG. 15), in which discharge cell are caused to emit in each of a number of continuous subfields corresponding to the brightness level of the input image signal within one field. By means of this first emission driving, there exist no emission driving patterns in which continuous emission intervals and continuous extinguished intervals are inverted within one field display interval, so that the occurrence of false contours is suppressed. Further, reset discharge, which incurs comparatively large power consumption, is executed only once, at the beginning of the field, so that power consumption can be suppressed.

On the other hand, when an image signal is input which has a high mean brightness level and also has a low vertical sync frequency, the second emission driving (FIG. 14 and FIG. 16) is executed, in which, in each of the first and second halves of one field, discharge cells are caused to emit in a number of continuous subfields corresponding to the brightness level of the input image signal. By means of this second emission discharge, there exist no emission discharge patterns within one field display interval such that continuous emission intervals and continuous extinguished intervals are inverted, so that the occurrence of false contours is suppressed. Further, by means of the second emission discharge, the number of times within one field display interval that there is switching from the continuous emission state to the continuous extinguished state is at most 2 times. Hence even when the input image signal is an image signal with a comparatively low vertical sync frequency, as in the case of PAL television signals, and moreover the brightness of the image signal is high, a good-quality image is displayed with flicker suppressed.

In the emission driving patterns corresponding to the first through 13th grayscales during second emission driving as shown in FIG. 14, selective erasing discharge is induced only one time each in the first half and in the second half of a field. However, when the amount of wall charge remaining within a discharge cell is small, even if a scan pulse SP and a high-voltage pixel data pulse are applied simultaneously, selective erasing discharge may not be induced normally.

Hence as the conversion table used by the second data conversion circuit 35, that shown in FIG. 18 may be adopted in place of the table of FIG. 14, in order to reliably induce this selective erasing discharge. By means of pixel driving data $GD_b$ converted using this conversion table, selective erasing discharge is induced in each of two continuous subfields, as indicated by the black circles in FIG. 18. Consequently, even if the wall charge within a discharge cell cannot be properly annihilated by the first selective erasing discharge, the wall charge can be annihilated normally through the second selective erasing discharge.

In the emission discharge format shown in FIG. 16, the subfields SF1, SF3, SF5, SF7, SF9, SF11, SF13 are executed in the first half of a field, and the subfields SF2, SF4, SF6, SF8, SF10, SF12, SF14 are executed in the second half; but other methods are possible.

Figure 19:
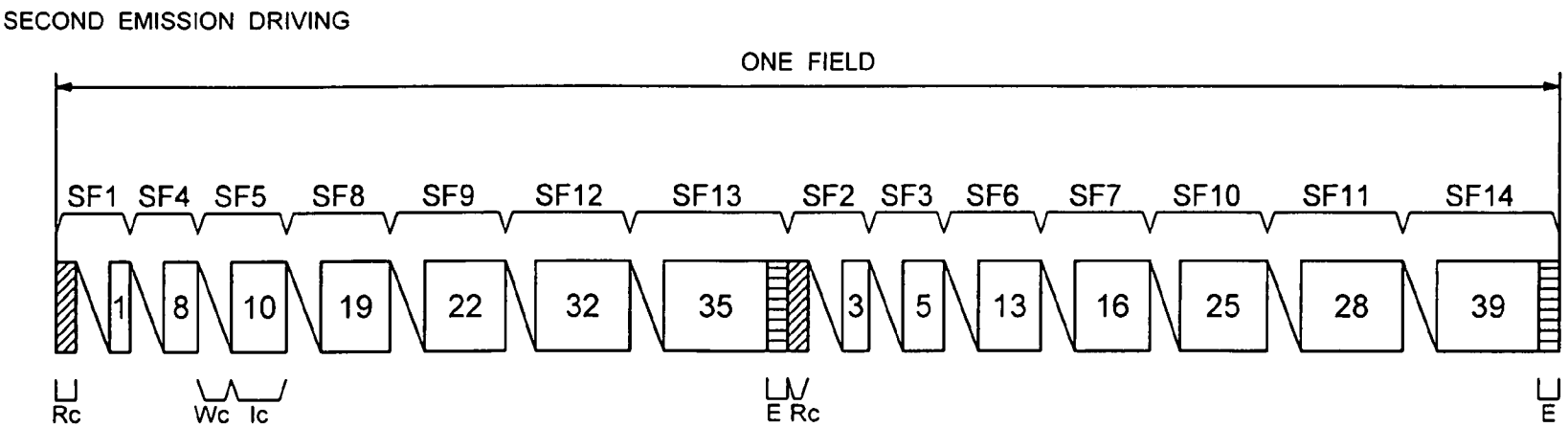
FIG. 19 is a figure showing another example of an emission driving format (based on the selective erasing address method) during the second emission driving.

FIG. 19 is a figure showing a modified example of the emission driving format shown in FIG. 16, in consideration of this point.

In the emission driving format shown in FIG. 19, the subfields SF1, SF4, SF5, SF8, SF9, SF12, SF13 are executed in order in the first half of a field, and in the second half, SF2, SF3, SF6, SF7, SF10, SF11, SF14 are executed in order.

FIG. 20 is a figure showing the data conversion table used in the second data conversion circuit 34 when executing emission driving control adopting the emission driving format shown in FIG. 19, and an emission driving pattern.

Here, the first through 14th bits of the pixel driving data $GD_b$ shown in FIG. 20 are associated with the subfields SF1 to SF14 shown in FIG. 19 as follows.

$GD_b$ 1st bit: SF1
$GD_b$ 2nd bit: SF4
$GD_b$ 3rd bit: SF5
$GD_b$ 4th bit: SF8
$GD_b$ 5th bit: SF9
$GD_b$ 6th bit: SF12
$GD_b$ 7th bit: SF13
$GD_b$ 8th bit: SF2
$GD_b$ 9th bit: SF3
$GD_b$ 10th bit: SF6
$GD_b$ 11th bit: SF7
$GD_b$ 12th bit: SF10
$GD_b$ 13th bit: SF11
$GD_b$ 14th bit: SF14

In the above embodiment, as the pixel data writing method, the so-called selective erasing address method was adopted in which all the discharge cells are initialized to the "lit discharge cell state" in advance, and the wall charge is eliminated selectively according to the pixel data to set the "extinguished discharge cell state".

However, it is possible to similarly apply this invention to the case in which the so-called selected writing address method is adopted as the pixel data writing method, in which the wall charge remaining in each discharge cell is annihilated, so that all discharge cells are initialized to the "extinguished discharge cell state", and wall charge is then formed selectively according to the pixel data.

Figure 21:
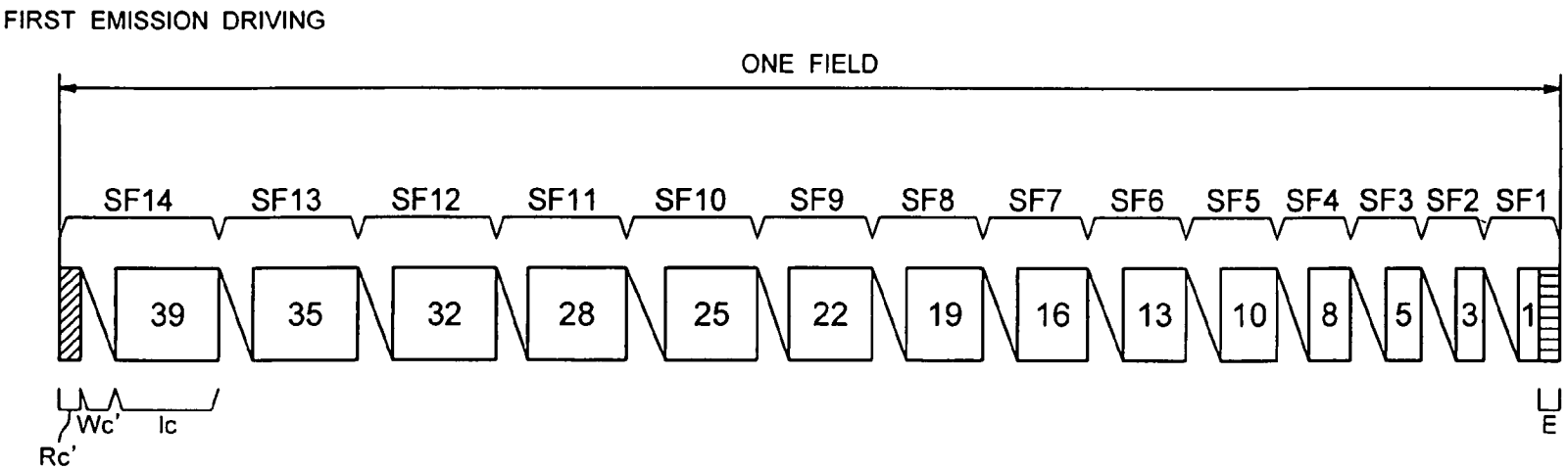
FIG. 21 is a figure showing an example of an emission driving format (based on the selected writing address method) during the first emission driving.
Figure 22:
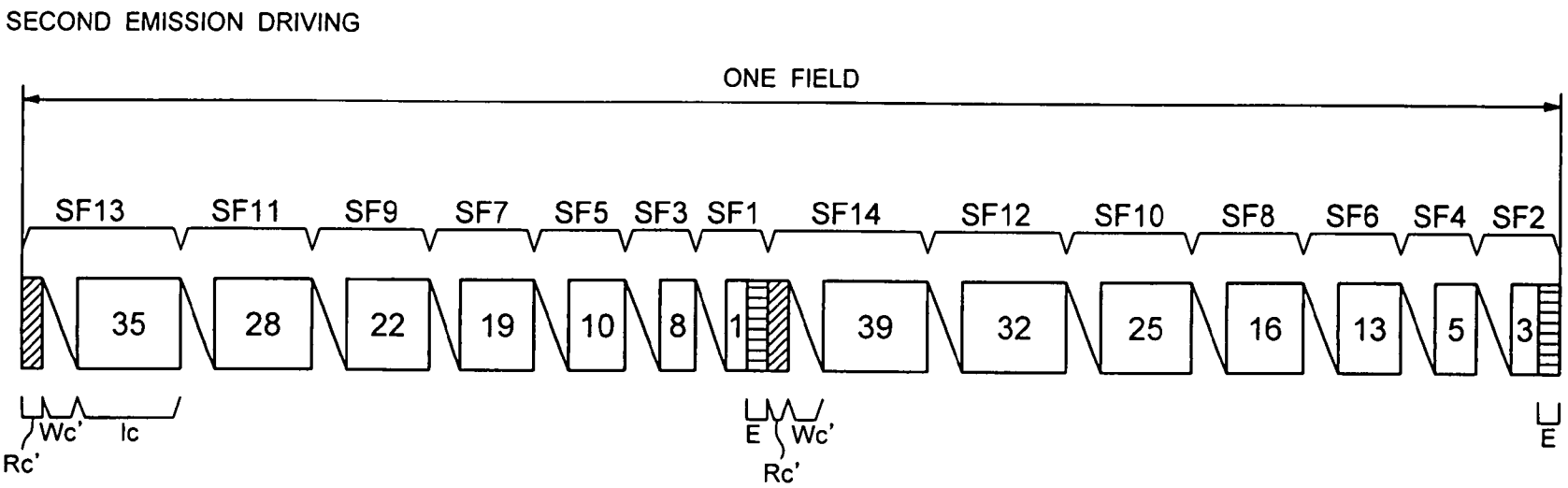
FIG. 22 is a figure showing another example of an emission driving format (based on the selected writing address method) during the second emission driving.

FIG. 21 is a figure showing an emission driving format during the first emission driving, used when adopting this selected writing address method, and FIG. 22 shows an emission driving format during the second emission driving. FIG. 23 is a figure showing the data conversion table used in the second date conversion circuit 34 when adopting the emission driving format shown in FIG. 21, and the emission driving pattern. Further, FIG. 24 shows the data conversion table used by the second data conversion circuit 35 when adopting the emission driving format shown in FIG. 22, and the emission driving pattern.

In the emission driving format used in the first emission driving shown in FIG. 21, as opposed to the emission driving format shown in FIG. 15, grayscale driving is executed in order from subfield SF14 to SF1. A simultaneous reset sequence Rc', in which the wall charge remaining in all discharge cells is eliminated simultaneously to initialize all discharge cells to the "extinguished discharge cell state", is executed only in the leading subfield SF14. Further, in each subfield an address sequence Wc' and an emission sustain sequence Ic are executed. Here, selected write discharge to form wall charge is induced only in the address sequences Wc' of subfields (indicated by black circles) corresponding to the digits of bits with a logical level "1" in the pixel driving data GD shown in FIG. 23. Discharge cells in which this selected writing discharge is induced are set to the "lit discharge cell state". Hence emission is executed in the emission sustain sequences Ic for subfields indicated by black or white circles in FIG. 23 only a number of times corresponding to the weighting of each subfield. In the first emission driving shown in FIG. 21 and FIG. 23, the number of switches from the continuous emission state, in which subfields of sustaining discharge emission (indicated by black or white circles in FIG. 23) are continuous, to the continuous extinguished state in which subfields in the extinguished state are continuous, is at most one. Hence among the 15 different emission driving patterns shown in FIG. 23, there exist no emission driving patterns in which the continuous emission state interval and the continuous extinguished state interval are inverted within the display interval for one field. Therefore when there are two adjacent screen regions within a screen such that the continuous emission state interval and the continuous extinguished state interval are mutually inverted, the occurrence of so-called false contours at the boundary between the regions is suppressed. Further, reset discharge, which has comparatively high power consumption, is executed only once at the beginning of the field even in the first emission driving shown in FIGS. 21 and 23, so that power consumption is suppressed.

On the other hand, in the emission driving format during second emission driving shown in FIG. 22, the subfields SF13, SF11, SF9, SF7, SF5, SF3, SF1 are executed in order in the first half of one field, and SF14, SF12, SF10, SF8, SF6, SF4, SF2 are executed in order in the second half. Here the simultaneous reset sequence Rc is executed, similarly to the case described above, in the leading subfield of the first half SF13 and in the leading subfield of the second half SF14. Also, within each subfield the above-described address sequence Wc' and emission sustain sequence Ic are executed. In this process, the first through 14th bits of the pixel driving data $GD_b$ shown in FIG. 24 correspond to the subfields SF1 to SF14 in FIG. 22 as follows.

$GD_b$ 1st bit: SF13
$GD_b$ 2nd bit: SF11

$GD_b$ 3rd bit: SF9
$GD_b$ 4th bit: SF7
$GD_b$ 5th bit: SF5
$GD_b$ 6th bit: SF3
$GD_b$ 7th bit: SF1
$GD_b$ 8th bit: SF14
$GD_b$ 9th bit: SF12
$GD_b$ 10th bit: SF10
$GD_b$ 11th bit: SF8
$GD_b$ 12th bit: SF6
$GD_b$ 13th bit: SF4
$GD_b$ 14th bit: SF2

Hence emission is performed the number of times corresponding to the weighting of subfields indicated by black and white circles in FIG. 24 only in the emission sustain sequence Ic. In this driving, switching from the continuous extinguished state to the continuous emission state is performed at most two times during the display interval for one field, similarly to the emission driving shown in FIG. 14.

When there is no cause for concern regarding flicker, because the vertical sync frequency of the input image signal is equal to or greater than a prescribed frequency (60 Hz), or because the mean brightness expressed by the input image signal is low, the driving control circuit 2 executes the first emission driving, shown in FIGS. 21 and 23. On the other hand, if the vertical sync frequency of the input image signal is lower than the prescribed frequency, and in addition the mean brightness is high, so that there is cause for concern regarding flicker, the second emission driving shown in FIGS. 22 and 24 is executed, so that switching during the display interval of one field from the continuous extinguished state to the continuous emission state occurs at most two times.

Also, in the second emission driving of the above embodiment, odd-numbered subfields are executed in the first half of the field, and even-numbered subfields are executed in the second half; but the two may be interposed.

Figure 25:
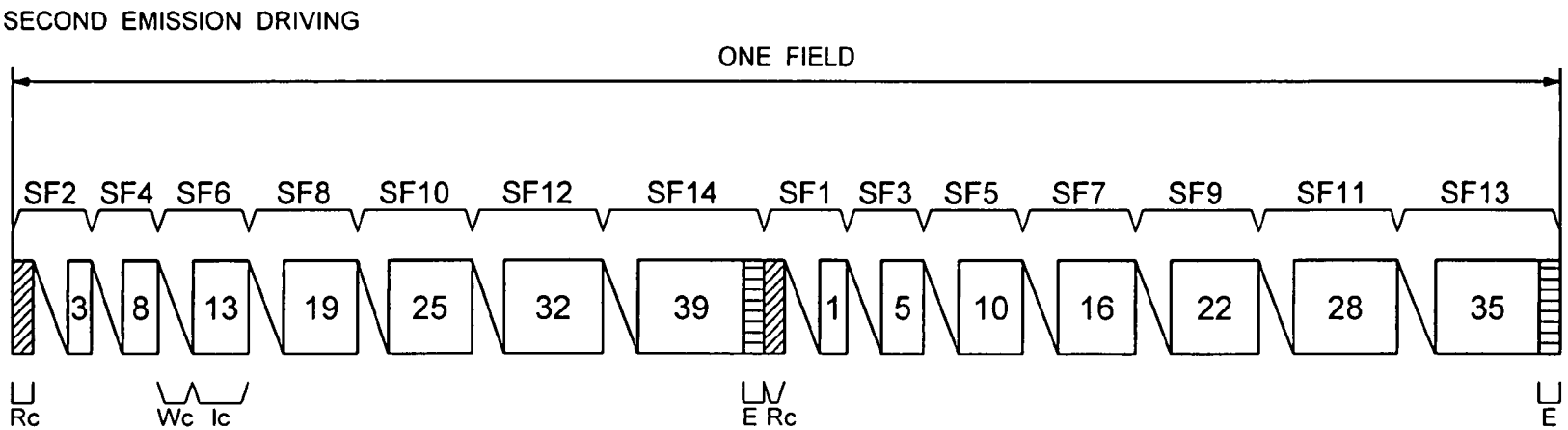
FIG. 25 is a figure showing a modified example of the emission driving format shown in FIG. 16.

FIG. 25 is a figure showing an emission driving format in second emission driving, taking this point into consideration.

In the emission driving format shown in FIG. 25, the subfields SF2, SF4, SF6, SF8, SF10, SF12, SF14, having ratios of the number of emissions to be performed in each emission sustain sequence Ic equal to [3:8:13:19:25:32:39], are executed in order in the first half of the field. In the second half of the field, the subfields SF1, SF3, SF5, SF7, SF9, SF11, SF13, having ratios of the number of emissions to be performed in each emission sustain sequence Ic equal to [1:5:10:16:22:28:35], are executed in order.

FIG. 26 is a figure showing the data conversion table used in the second data conversion circuit 35 when adopting the emission driving format shown in FIG. 25, and the emission driving pattern.

Here, the first through 14th bits of the pixel driving data $GD_b$ shown in FIG. 26 are associated with the subfields SF1 to SF14 shown in FIG. 25 as follows.

$GD_b$ 1st bit: SF2
$GD_b$ 2nd bit: SF4
$GD_b$ 3rd bit: SF6
$GD_b$ 4th bit: SF8
$GD_b$ 5th bit: SF10
$GD_b$ 6th bit: SF12
$GD_b$ 7th bit: SF14
$GD_b$ 8th bit: SF1
$GD_b$ 9th bit: SF3
$GD_b$ 10th bit: SF5
$GD_b$ 11th bit: SF7
$GD_b$ 12th bit: SF9
$GD_b$ 13th bit: SF11
$GD_b$ 14th bit: SF13

That is, in the second emission driving shown in FIGS. 25 and 26, the subfield series of the first half of the field in the second emission driving shown in FIGS. 14 and 16 (SF1, SF3, SF5, SF7, SF9, SF11, SF13) and the subfield series of the second half (SF2, SF4, SF6, SF8, SF10, SF12, SF14) are inverted.

Figure 27:
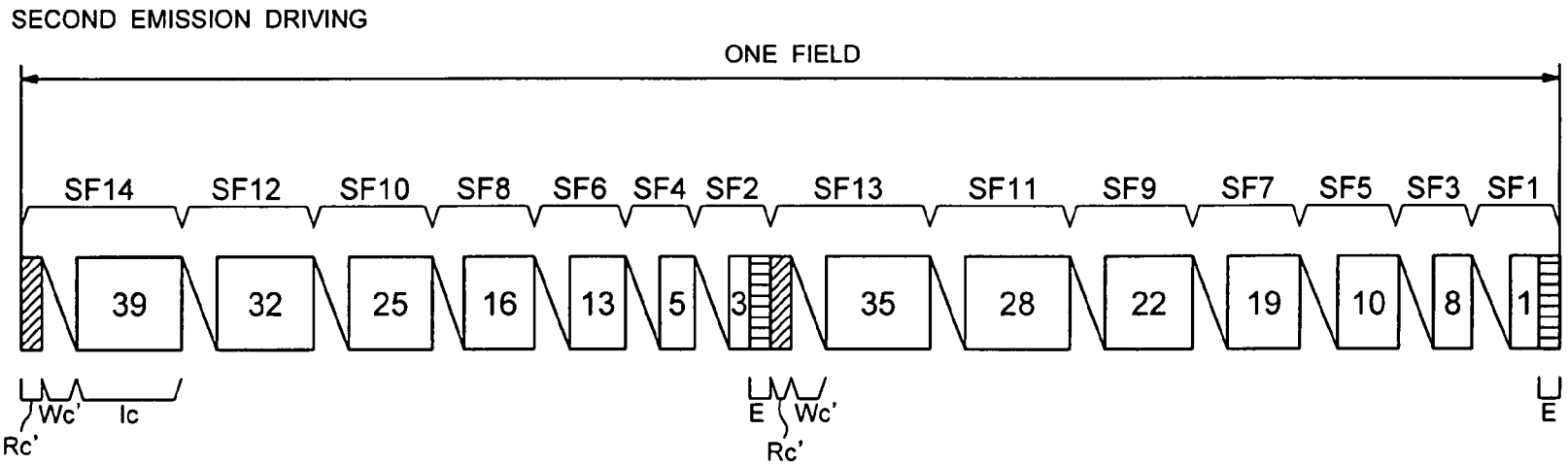
FIG. 27 is a figure showing a modified example of the emission driving format shown in FIG. 22.

Similarly, in the second emission driving shown in FIGS. 27 and 28, the subfield series of the first half of the field in the second emission driving shown in FIGS. 22 and 24 (SF13, SF11, SF9, SF7, SF5, SF3, SF1) and the subfield series of the second half (SF14, SF12, SF10, SF8, SF6, SF4, SF2) are inverted.

In the above embodiment, one field is divided into an even number (14) of subfields to perform grayscale driving of the PDP 10; but the number of subfields into which the field is divided is not limited to an even number.

FIG. 29 an d FIG. 30 are figures showing an example of the emission driving pattern in second emission driving adopted when one field is divided into an odd number (13) of subfields to drive the PDP 10. FIG. 29 and FIG. 30 show the emission driving patterns in second emission driving when adopting the selective erasing address method and the selected writing address method, respectively.

In the emission driving pattern shown in FIG. 29, subfields SF1, SF3, SF5, SF7, SF9, SF11, SF13, having a ratio of the number of times emission is to be executed in each emission sustain sequence Ic equal to [1:5:10:16:22:28:35], are executed in order in the first half of the field. In the second half of the field, subfields SF2, SF4, SF6, SF8, SF10, SF12, having a ratio of the number of times emission is to be executed in each emission sustain sequence Ic equal to [3:8:13:19:25:32], are executed in order.

In the emission driving pattern shown in FIG. 30, subfields SF13 SF11, SF9, SF7, SF5, SF3, SF1, having a ratio of the number of times emission is to be executed in each emission sustain sequence Ic equal to [35:28:22:16:10:5:1], are executed in order in the first half of the field. In the second half of the field, subfields SF12, SF10, SF8, SF6, SF4, SF2, having a ratio of the number of times emission is to be executed in each emission sustain sequence Ic equal to [32:25:19:13:8:3], are executed in order.

As explained in detail above, in this invention, when an image signal with low mean brightness is input, or when an image signal with a high vertical sync frequency is input, emission elements comprised by pixels are caused to emit in a number of continuous subfields within one field corresponding to the brightness level expressed by the input image signal. By means of this driving, there exist no emission driving patterns in which a continuous emission interval and a continuous extinguished interval within one field are inverted, so that the occurrence of false contours is suppressed. On the other hand, when an image signal with a high mean brightness, and which has a low vertical sync frequency, is input, emission elements are caused to emit in each of a number of continuous subfields, in the first half and in the second half of a field, according to the brightness level expressed by the image signal. By means of this driving, the number of times there is switching from the continuous emission state to the continuous extinguished state within the display interval for one field is two times. Hence even if an image signal is input with a low vertical sync frequency, such as a PAL television signal, and in addition the mean brightness is high, a good-quality image is displayed, with false contours as well as flicker suppressed.

This application is based on Japanese Patent Application No. 2001-181109 which is herein incorporated by reference.

What is claimed is:

1. A display panel driving method for performing emission driving of each of light emission elements in a display panel in which the display screen is formed by a plurality of said light emission elements in each of N subfields constituting one field interval of the input image signal; wherein light emissions in said N subfields are performed in such a way that a light emitting state is produced in said N subfields in an ascending order of weightings of the subfields, in which in order to realize an m-th grayscale level (where m is a natural number from 1 to N+1), light emission is performed in one subfield in addition to subfields in which light emission is performed to realize an (m−1)th grayscale level, and according to at least one of the magnitude of the vertical sync frequency of said input image signal and the mean brightness of the screen expressed by said input image signal, switching between first and second emission driving sequences is performed, wherein said first emission driving sequence begins with a reset step provided in a head subfield, to display intermediate brightnesses in N+1 stages, from a first grayscale to an (N+1)th grayscale, by causing emission of said light emission elements in each of n (where n is an integer from 0 to N) of said subfields continuously within said field interval, in a number corresponding to the brightness level expressed by said input image signal, and said second emission driving sequences comprises first and second halves of said field interval each of which begins with a reset step provided in a head subfield, in which at least a pair of subfields, which have weighting values adjoining in an order of the subfields' weightings, are arranged at an interval of nearly one-half of said field interval, and in which, after causing emission of said light emission elements in each of said continuous subfields in the first half of said field interval, in a number corresponding to the brightness level expressed by said input image signal, said light emission elements are caused to emit in each of said continuous subfields in the second half of said field interval, in a number corresponding to the brightness level expressed by said input image signal, whereby intermediate brightness is displayed in N+1 stages, from a first grayscale to an (N+1)th grayscale.

2. The display panel driving method according to claim 1, wherein the time between the moment of initiation of emission in said first-half interval, and the moment of initiation of emission in said second-half interval, is substantially one-half of said field interval.

3. The display panel driving method according to claim 1, wherein, said first emission driving sequence is executed when said vertical sync frequency of said input image signal is higher than a prescribed frequency, or when said mean brightness is lower than a prescribed brightness, and when said vertical sync frequency is lower than said prescribed frequency and in addition said mean brightness is higher than said prescribed brightness, said second emission driving sequence is executed.

4. The display panel driving method according to claim 1, wherein said second emission driving sequence comprises:

a first reset sequence, which initializes all of said light emission elements to the lit state only in said leading subfield in said first-half interval; a first address sequence, which sets each of said light emission elements to either said lit state or to the extinguished state in one of said subfields within said first-half interval according to said input image signal; a first emission sustain sequence, in which, in each of said subfields in said first-half interval, only those of said light emission elements which are in said lit state are caused to emit a number of times corresponding to the weighting of said subfield;

a second reset sequence, which initializes all of said light emission elements to the lit state only in said leading subfield in said second-half interval; a second address sequence, which sets each of said light emission elements to either said lit state or to the extinguished state in one of said subfields within said second-half interval according to said input image signal; and a second emission sustain sequence, in which, in each of said subfields in said second-half interval, only those of said light emission elements which are in said lit state are caused to emit a number of times corresponding to the weighting of said subfield.

5. The display panel driving method according to claim 1, wherein:

when said number N is an even number, at said first grayscale said light emission elements are not caused to emit in any of said subfields; at the second grayscale, said light emission elements are caused to emit only in said leading subfield of either said first-half interval or said second-half interval; at the third grayscale, said light emission elements are caused to emit, in addition to the subfield executed at the second grayscale, only in said leading subfield of the other half, among said first-half interval and said second-half interval; at the fourth grayscale, said light emission elements are caused to emit, in addition to the subfields executed at the third grayscale, in the subfield arranged second in either said first-half interval or in said second-half interval; at the Nth grayscale, said light emission elements are caused to emit, in addition to the subfields executed at the (N−1)th grayscale, in the last of said subfields in either said first-half interval or in said second-half interval; and at the (N+1)th grayscale, said light emission elements are caused to emit, in addition to the subfields executed at the Nth grayscale, in the last of said subfields of the other half, among said first-half interval and said second-half interval; and, when said number N is an odd number, at said first grayscale said light emission elements are not caused to emit in any of said subfields; at the second grayscale, said light emission elements are caused to emit only in said leading subfield of either said first-half interval or said second-half interval; at said third grayscale, said light emission elements are caused to emit, in addition to the subfield executed at said second grayscale, only in said leading subfield of the other half, among said first-half interval and said second-half interval; at the fourth grayscale, said light emission elements are caused to emit, in addition to the subfields executed at said third grayscale, in the subfield arranged second in either said first-half interval or in said second-half interval; at the Nth grayscale, said light emission elements are caused to emit, in addition to the subfields executed at the (N−1)th grayscale, in the last of said subfields in one of said first-half interval or said second-half interval; and at the (N+1)th grayscale, said light emission elements are caused to emit, in addition to the subfields executed at the Nth grayscale, in the last of said subfields of the other half, among said first-half interval and said second-half interval.

6. The display panel driving method according to claim 1, wherein:

when said number N is an even number, at said first grayscale said light emission elements are not caused to emit in any of said subfields; at the second grayscale, said light emission elements are caused to emit only in the last subfield of either said first-half interval or said second-half interval; at the third grayscale, said light emission elements are caused to emit, in addition to the subfield executed at the second grayscale, only in the last subfield of the other half, among said first-half interval and said second-half interval; at the fourth grayscale, said light emission elements are caused to emit, in addition to the subfields executed at the third grayscale, in the subfield arranged second to last in either said first-half interval or in said second-half interval; at the Nth grayscale, said light emission elements are caused to emit, in addition to the subfields executed at the (N−1)th grayscale, in the first of said subfields in either said first-half interval or in said second-half interval; and at the (N+1)th grayscale, said light emission elements are caused to emit, in addition to the subfields executed at the Nth grayscale, in the first of said subfields of the other half, among said first-half interval and said second-half interval; and, when said number N is an odd number, at said first grayscale said light emission elements are not caused to emit in any of said subfields; at the second grayscale, said light emission elements are caused to emit only in the last subfield of either said first-half interval or said second-half interval; at the third grayscale, said light emission elements are caused to emit, in addition to the subfield executed at said second grayscale, only in the last subfield of the other half, among said first-half interval and said second-half interval; at the fourth grayscale, said light emission elements are caused to emit, in addition to the subfields executed at said third grayscale, in the subfield arranged second to last in either said first-half interval or in said second-half interval; at the Nth grayscale, said light emission elements are caused to emit, in addition to the subfields executed at the (N−1)th grayscale, in the first of said subfields in one of said first-half interval or said second-half interval; and at the (N+1)th grayscale, said light emission elements are caused to emit, in addition to the subfields executed at the Nth grayscale, in the first of said subfields of the other half, among said first-half interval and said second-half interval.

7. The display panel driving method according to claim 1, wherein said first emission driving sequence begins with said reset step provided only in said head subfield.

8. The display panel driving method according to claim 1, wherein said N is a constant value.

9. A method for driving light emission elements in a display panel, wherein N subfields constitutes one field interval of an input image signal, comprising:

performing light emission in said N subfields in an ascending order of weightings of the subfields;

realizing an m-th grayscale level (where m is a natural number from 1 to N+1) by performing light emission in one subfield in addition to performing light emission in subfields to realize an (m−1)th grayscale level;

switching between first and second emission driving sequences according to at least one of a magnitude of a vertical sync frequency of said input image signal and a mean brightness of the display panel expressed by said input image signal, wherein said first emission driving sequence comprises resetting a head subfield to display intermediate brightnesses in N+1 stages, from a first grayscale to an (N+1)th grayscale, by performing light emission in each of n of said subfields continuously within said field interval, in a number corresponding to the brightness level expressed by said input image signal, wherein n is an integer from 0 to N), and wherein said second emission driving sequence comprises:

in a first half of said field interval, resetting a head subfield, in which at least a pair of subfields, which have weighting values adjoining in an order of the subfields' weightings, are arranged at an interval of nearly one-half of said field interval, performing light emission in each of said continuous subfields in the first half of said field interval, in a number corresponding to the brightness level expressed by said input image signal, after performing said light emission in each of said continuous subfield in said second emission driving sequence, performing light emission in each of said continuous subfields in the second half of said field interval, in a number corresponding to the brightness level expressed by said input image signal, wherein intermediate brightness is displayed in N+1 stages, from a first grayscale to an (N+1)th grayscale.

10. The display panel driving method according to claim 9, wherein the time between the moment of initiation of emission in said first-half interval, and the moment of initiation of emission in said second-half interval, is substantially one-half of said field interval.

11. The display panel driving method according to claim 9, wherein said first emission driving sequence is executed when said vertical sync frequency of said input image signal is higher than a prescribed frequency, or when said mean brightness is lower than a prescribed brightness, and when said vertical sync frequency is lower than said prescribed frequency and said mean brightness is higher than said prescribed brightness, said second emission driving sequence is executed.

12. The display panel driving method according to claim 9, wherein said second emission driving sequence comprises:

a first reset sequence, which initializes all of said light emission elements to the lit state only in said leading subfield in said first-half interval;

a first address sequence, which sets each of said light emission elements to either said lit state or to the extinguished state in one of said subfields within said first-half interval according to said input image signal;

a first emission sustain sequence, in which, in each of said subfields in said first-half interval, only those of said light emission elements which are in said lit state are caused to emit a number of times corresponding to the weighting of said subfield;

a second reset sequence, which initializes all of said light emission elements to the lit state only in said leading subfield in said second-half interval;

a second address sequence, which sets each of said light emission elements to either said lit state or to the extinguished state in one of said subfields within said second-half interval according to said input image signal; and a second emission sustain sequence, in which, in each of said subfields in said second-half interval, only those of said light emission elements which are in said lit state are caused to emit a number of times corresponding to the weighting of said subfield.

13. The display panel driving method according to claim 9, wherein:

when said number N is an even number, at said first grayscale said light emission elements are not caused to emit in any of said subfields; at the second grayscale, said light emission elements are caused to emit only in said leading subfield of either said first-half interval or said second-half interval; at the third grayscale, said light emission elements are caused to emit, in addition to the subfield executed at the second grayscale, only in said leading subfield of the other half, among said first-half interval and said second-half interval; at the fourth grayscale, said light emission elements are caused to emit, in addition to the subfields executed at the third grayscale, in the subfield arranged second in either said first-half interval or in said second-half interval; at the Nth grayscale, said light emission elements are caused to emit, in addition to the subfields executed at the (N−1)th grayscale, in the last of said subfields in either said first-half interval or in said second-half interval; and at the (N+1)th grayscale, said light emission elements are caused to emit, in addition to the subfields executed at the Nth grayscale, in the last of said subfields of the other half, among said first-half interval and said second-half interval; and, when said number N is an odd number, at said first grayscale said light emission elements are not caused to emit in any of said subfields; at the second grayscale, said light emission elements are caused to emit only in said leading subfield of either said first-half interval or said second-half interval; at said third grayscale, said light emission elements are caused to emit, in addition to the subfield executed at said second grayscale, only in said leading subfield of the other half, among said first-half interval and said second-half interval; at the fourth grayscale, said light emission elements are caused to emit, in addition to the subfields executed at said third grayscale, in the subfield arranged second in either said first-half interval or in said second-half interval; at the Nth grayscale, said light emission elements are caused to emit, in addition to the subfields executed at the (N−1)th grayscale, in the last of said subfields in one of said first-half interval or said second-half interval; and at the (N+1)th grayscale, said light emission elements are caused to emit, in addition to the subfields executed at the Nth grayscale, in the last of said subfields of the other half, among said first-half interval and said second-half interval.

14. The display panel driving method according to claim 9, wherein:

when said number N is an even number, at said first grayscale said light emission elements are not caused to emit in any of said subfields; at the second grayscale, said light emission elements are caused to emit only in the last subfield of either said first-half interval or said second-half interval; at the third grayscale, said light emission elements are caused to emit, in addition to the subfield executed at the second grayscale, only in the last subfield of the other half, among said first-half interval and said second-half interval; at the fourth grayscale, said light emission elements are caused to emit, in addition to the subfields executed at the third grayscale, in the subfield arranged second to last in either said first-half interval or in said second-half interval; at the Nth grayscale, said light emission elements are caused to emit, in addition to the subfields executed at the (N−1)th grayscale, in the first of said subfields in either said first-half interval or in said second-half interval; and at the (N+1)th grayscale, said light emission elements are caused to emit, in addition to the subfields executed at the Nth grayscale, in the first of said subfields of the other half, among said first-half interval and said second-half interval; and, when said number N is an odd number, at said first grayscale said light emission elements are not caused to emit in any of said subfields; at the second grayscale, said light emission elements are caused to emit only in the last subfield of either said first-half interval or said second-half interval; at the third grayscale, said light emission elements are caused to emit, in addition to the subfield executed at said second grayscale, only in the last subfield of the other half, among said first-half interval and said second-half interval; at the fourth grayscale, said light emission elements are caused to emit, in addition to the subfields executed at said third grayscale, in the subfield arranged second to last in either said first-half interval or in said second-half interval; at the Nth grayscale, said light emission elements are caused to emit, in addition to the subfields executed at the (N−1)th grayscale, in the first of said subfields in one of said first-half interval or said second-half interval; and at the (N+1)th grayscale, said light emission elements are caused to emit, in addition to the subfields executed at the Nth grayscale, in the first of said subfields of the other half, among said first-half interval and said second-half interval.

15. The display panel driving method according to claim 9, wherein said first emission driving sequence begins with said reset step provided only in said head subfield.

16. The display panel driving method according to claim 9, wherein said N is a constant value.

* * * * *